US006762976B1

(12) United States Patent
Tamaru et al.

(10) Patent No.: US 6,762,976 B1
(45) Date of Patent: Jul. 13, 2004

(54) WRISTWATCH CASE

(75) Inventors: Katsuaki Tamaru, Tanashi (JP); Ryo Fujita, Tanashi (JP); Susumu Tosaka, Tanashi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/674,086

(22) PCT Filed: Feb. 25, 2000

(86) PCT No.: PCT/JP00/01084

§ 371 (c)(1),
(2), (4) Date: Oct. 26, 2000

(87) PCT Pub. No.: WO00/50962

PCT Pub. Date: Aug. 31, 2000

(30) Foreign Application Priority Data

| | | |
|---|---|---|
| Feb. 26, 1999 | (JP) | 11-049388 |
| Mar. 9, 1999 | (JP) | 11-061555 |
| May 17, 1999 | (JP) | 11-135722 |
| Jan. 13, 2000 | (JP) | 2000-004173 |

(51) Int. Cl.[7] ..... G04B 37/00; G04B 29/00; A44C 5/00

(52) U.S. Cl. ..... 368/88; 368/281; 368/287; 368/291; 368/294; 368/300

(58) Field of Search ..... 368/88, 276, 281–287, 368/291, 294–300, 309

(56) References Cited

U.S. PATENT DOCUMENTS

| | | | | |
|---|---|---|---|---|
| 3,643,423 A | * | 2/1972 | Piquerez | |
| 5,033,035 A | * | 7/1991 | Affolter | 368/294 |
| 5,237,546 A | * | 8/1993 | Vollert | 368/294 |
| 6,213,635 B1 | * | 4/2001 | Savy et al. | 368/299 |
| 6,406,178 B1 | * | 6/2002 | Luscher et al. | 368/286 |

FOREIGN PATENT DOCUMENTS

| | | |
|---|---|---|
| GB | A2156111 | 10/1985 |
| JP | A4982367 | 8/1974 |
| JP | A5254465 | 5/1977 |
| JP | Y2-5242769 | 9/1977 |
| JP | A5570769 | 5/1980 |
| JP | A61254881 | 11/1986 |
| JP | U6410689 | 1/1989 |
| JP | U374387 | 7/1991 |
| JP | Y2626874 | 7/1994 |

* cited by examiner

*Primary Examiner*—Vit W. Miska
(74) *Attorney, Agent, or Firm*—Birch, Stewart, Kolasch & Birch, LLP

(57) ABSTRACT

There is disposed a middle comprising a metallic inner middle (20) in which a movement (30) is housed, and a metallic outer middle (21) covering at least a part of the inner middle, and an elastic shock absorber (35) disposed between the inner middle and the outer middle.

27 Claims, 44 Drawing Sheets

WRISTWATCH CASE

This application is the national phase under 35 U.S.C. § 371 of PCT International Application No. PCT/JP00/01084 which has an International filing date of Feb. 25, 2000, which designated the United States of America.

TECHNICAL FIELD

The present invention relates to a watchcase, and more particularly to a watchcase having a shockproof structure for protecting a movement (including a module) provided in the case.

BACKGROUND ART

As one of the shockproof structures where the movement in the watchcase is protected from an externally applied shock, there is known a watchcase disclosed in Japanese Utility Model Application Laid Open 6-17110.

FIG. 47 is a sectional view showing a watchcase of the conventional art. The case has a shock absorber 3 made of such an elastic material as polyurethane rubber disposed between a metallic inner middle 1 and an outer middle 2 made of hard synthetic resin. The shock absorber 3 is inserted between the inner middle 1 and the outer middle 2 so as to cover an upper surface 1*a* of the inner middle 1 and the outer periphery of an annular projection 1*b* provided for holding a glass 4. The inner middle 1 and the outer middle 2 are attached to each other by a plurality of fixing screws 5. A metallic back 7 is fixed to the inner middle 1 by screws 8.

The shockproof structure is advantageous in that a shock applied to the watchcase is absorbed by elastic deformation of the shock absorber 3, thereby decreasing the shock transmitted to a movement 6.

FIG. 48 shows a section wherein a screw-lock crown is applied to the above-described prior art. The screw-lock crown comprises a support pipe 17 securely mounted in a hole 16*a* in the inner middle 1, a crown head 10 connected to the support pipe 17 by a screw thread 18, a stem connecting member 13 connected to a stem 11 of the watch and rotatably mounted in the support pipe 17, and a stopping ring 9 engaged with the stem connecting member 13.

When the crown head 10 is rotated so that the screw thread 18 is released from the support pipe 17, a coil spring 14 urges the head 10 to project outward. Hence, an engaging hole 15 polygonal in section and formed in an inner wall of the head engages a corresponding polygonal engaging portion 16 formed on the outer wall of the stem connecting member 13. When the head is rotated, the stem 11 is rotated by way of the stem connecting member 13, so that time can be set.

In order to protect the crown from shock, there is often provided a crown guard 19 in such a watch having a shockproof structure. The crown guard 19 comprises a pair of protecting wall projecting from the outer middle 2 so as to interpose the crown head 10 therebetween. The dimensions of the guard 19 with regard to both the height and the length thereof, are rendered larger than those of the crown head so as to prevent the shock from being exerted on the crown head 10. Hence it is possible to prevent such accidents as the stem 11 connected to the crown being bent or broken by the shock.

However, in the above-described shockproof structure, at the portion where the shock absorber is not provided, since an outer peripheral wall 1*c* of the inner middle 1 and an inner peripheral wall 2*a* of the outer middle 2 closely abuts against each other, the external shock exerted on the outer middle 2 may be directly transmitted to the inner middle 1. Moreover, the external shock exerted on the outer middle. 2 is also transmitted to the inner middle 1 through the fixing screws 5.

As a result, the shock is further applied to the movement 6 housed in the inner middle, so that the movement 6 may be broken.

More particularly, the underside of the inner middle 1 is covered neither by the shock absorber nor the outer middle. Thus, if the watch is dropped so that a shock is applied to the underside of the inner middle, the shock cannot be absorbed at all.

In addition, although the outer middle 2 covers the upper surface and the periphery of the inner middle, the underside of the inner middle is not covered. Hence, when the screws 8 become loose, the inner middle may fall out downwardly from the outer middle.

Furthermore, since the outer middle 2 of the above described shockproof structure is made of a synthetic resin, although hard, it does not have a sufficient strength, anti-scratch property and abrasion resistance. Accordingly, when an excessive degree of shock is applied to the watch, the outer middle of hard synthetic resin may be broken although the shock absorber interposed between the inner and outer middles can be elastically deformed. Moreover, if the watch is used for a long period of time, the outer middle may be injured or abraded.

In addition, if the fixing screws 5 become loose, the shock absorber 3 may be disengaged from the outer middle 2.

Meanwhile, in the case where the screw-lock crown is used as in FIG. 48, when a shock is exerted on the outer middle 2, the stem connecting member 13 and the stem 11 move into the movement 6, so that the stem bumps against the components such as gears in the movement. Thus the components of the movement may be displaced or broken.

On the other hand, since the crown guard 19 is larger than the crown head 10, the fingers of the watch wearer are hindered from touching the head 10. As a result, it is difficult to turn the crown head 10 with the fingers.

The first object of the present invention is to provide a shockproof structure for a watchcase where a shock is sufficiently absorbed.

The second object of the present invention is to provide a shockproof structure for a watchcase where an outer middle and an inner middle are securely fixed.

The third object of the present invention is to provide a shockproof structure for a watchcase having sufficient strength, anti-scratch property, and abrasion resistance.

The fourth object of the present invention is to provide a watchcase having a crown guard where the crown can be easily manipulated.

The fifth object of the present invention is to provide a watchcase where a shock absorber is not detached from a middle.

DISCLOSURE OF THE INVENTION

According to the present invention, there is provided a watchcase comprising a middle comprising a metallic inner middle in which a movement is housed, and a metallic outer middle covering at least a part of the inner middle, and an elastic shock absorber disposed between the inner middle and the outer middle.

According to another feature of the present invention, there is provided a watchcase comprising a middle comprising an inner middle in which a movement is housed, and an outer middle covering at least a part of the inner middle, and a securing member attached to the outer middle and inserted in the inner middle so that the inner and outer middles are attached to each other.

According to a further feature of the present invention, there is provided a watchcase comprising a middle comprising an inner middle in which a movement is housed, and an outer middle covering at least a part of the inner middle, an elastic shock absorber attached to one of the inner middle and the outer middle, a securing member having securing means on a part thereof and attached to one of the inner middle and the outer middle by the securing means so as to oppose the other middle interposing the shock absorber at a portion where the securing means is not provided.

According to a still further feature of the present invention, there is provided a watchcase comprising a crown, a stem connecting member provided on the crown, and connected to a stem of a movement housed in a middle, and a movement restricting member provided between the stem connecting member and the movement for restricting the movement of the stem connecting member and the stem toward the movement.

According to a still further feature of the present invention, there is provided a watchcase comprising a crown, and a guard pipe attached to a middle of the watchcase and in which guard pipe the crown is inserted, wherein an outer wall of a head of the crown is positioned at a position inner than an outer peripheral wall of the guard pipe.

According to a still further feature of the present invention, there is provided a watchcase having an elastic planar top shock absorber interposed between a bezel and a middle and a securing means for attaching the bezel and the middle to each other.

According to a still further feature of the present invention, there is provided a watchcase having an elastic ornamental ring shock absorber disposed between a shield holding member and an ornamental ring disposed above a dial.

According to a still further feature of the present invention, there is provided a watchcase having an elastic movement shock absorber provided between an ornamental ring disposed above a dial and a movement.

According to a still further feature of the present invention, there is provided a watchcase having an elastic bottom shock absorber disposed between an underside of a movement and a bottom of an inner wall of a middle.

According to a still further feature of the present invention, there is provided a watchcase comprising an inner middle in which a movement is housed and an outer middle covering at least a part of the inner middle, wherein the outer middle comprises an inner shell made of a hard material and an outer shell made of a soft material.

According to a still further feature of the present invention, there is provided a watchcase comprising an inner middle for housing a movement, and an outer middle for housing the inner middle, wherein the inner middle and the outer middle is attached to each other only by interposing a shock absorber therebetween.

According to a still further feature of the present invention, there is provided a watchcase comprising an inner middle for housing a movement, and an outer middle for housing the inner middle, including a shock absorber provided between the inner middle and the outer middle, wherein a space is formed between the inner middle and the outer middle except for a portion where the shock absorber is disposed.

According to a still further feature of the present invention, there is provided a watchcase having a pair of crown guards projecting adjacent a crown, wherein a notch is formed on each crown guard so as to expose an outer periphery of the crown.

BEST MODE FOR EMBODYING THE INVENTION

Figure 1:
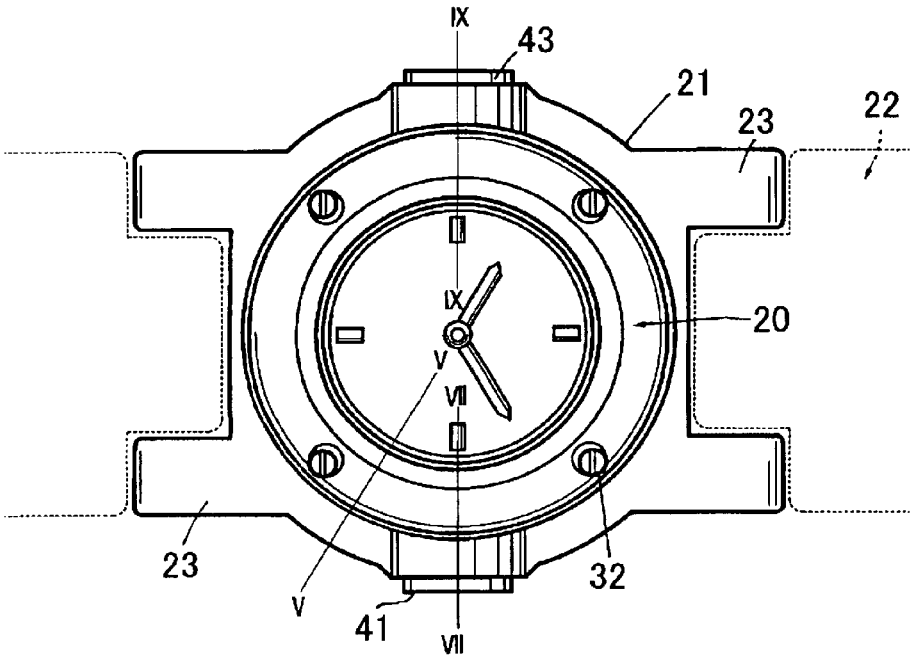
FIG. 1 is a plan view of a watch according to a first embodiment of the present invention.
Figure 2:
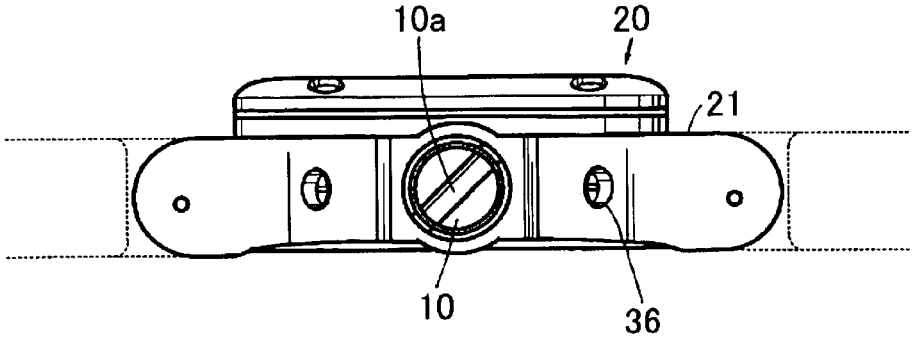
FIG. 2 is an elevational view of the watch.
Figure 3:
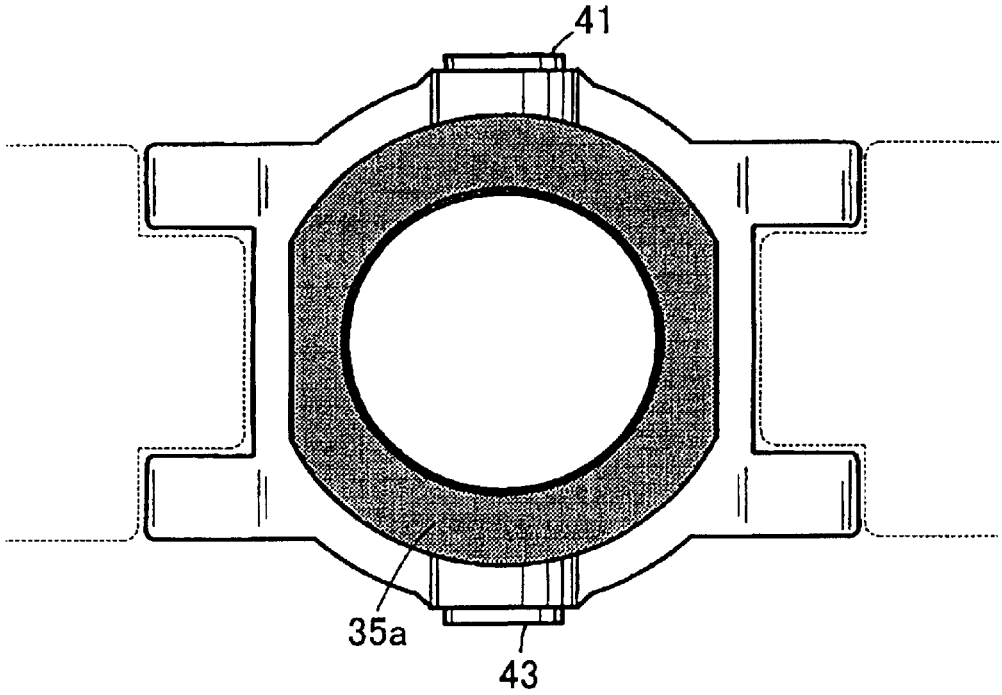
FIG. 3 shows the underside of the watch.
Figure 4:
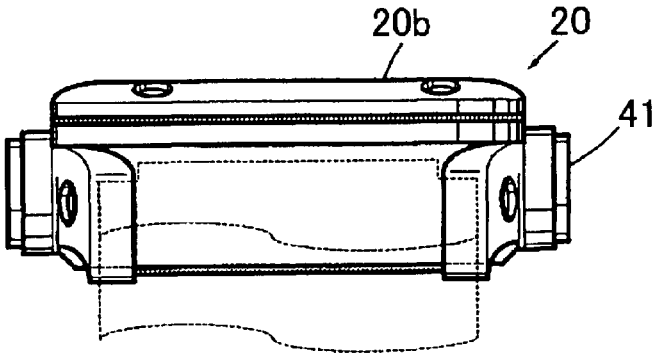
FIG. 4 is a right elevational view of the watch.

FIG. 1 is the plan view of a watch according to the first embodiment of the present invention, FIG. 2 is the elevational view of the watch, FIG. 3 shows the underside of the watch, and FIG. 4 is the right elevational view of the watch.

The watchcase according to the present invention comprises a metallic inner middle 20 and a metallic outer middle 21. The outer middle 21 has on each side thereof, a pair of connecting legs 23 for connecting a band 22. A hard material such as titanium and titanium alloy is preferable as the metal.

Figure 5:
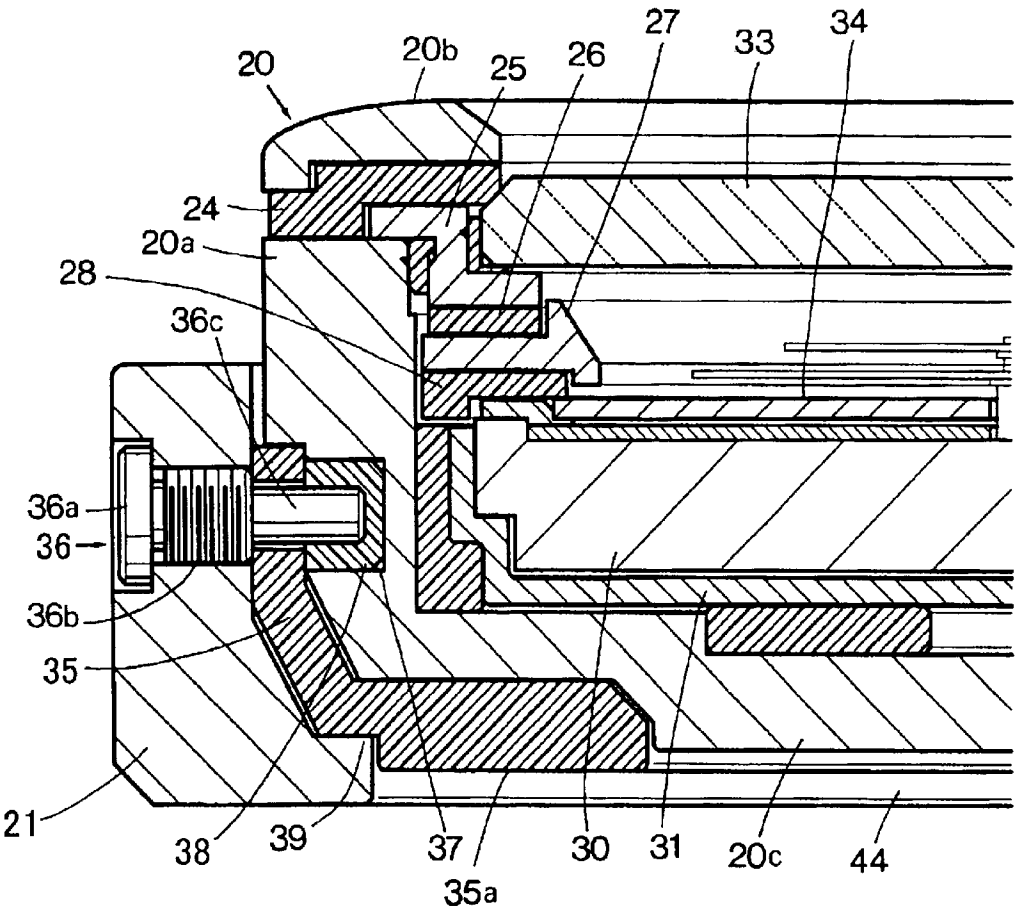
FIG. 5 is a sectional view taken along a line V—V of FIG. 1.
Figure 6:
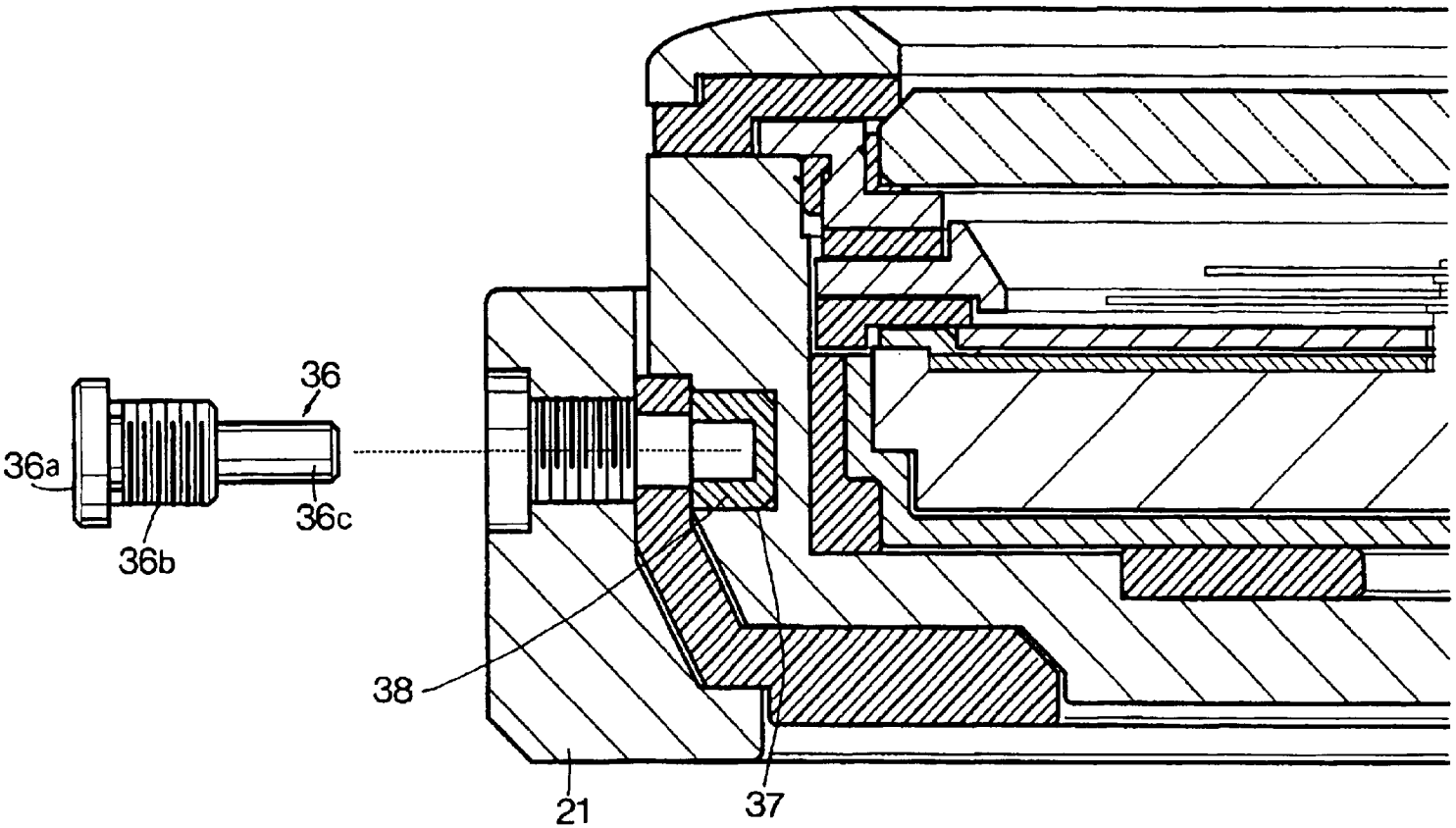
FIG. 6 is an exploded view of FIG. 5.

The inner middle 20 comprises a body 20*a* and a bezel 20*b* as shown in FIGS. 5 and 6. An annular elastic shock absorber 24 made of synthetic resin and a shield holding ring 25 are interposed between the body 20*a* and the bezel 20*b*. A shock absorber 26, ornamental ring 27, shock absorber 28, movement 30, and a magnetic shielding member 31 are sequentially mounted on top of the other between the holding ring 25 and a bottom 20*c* of the body 20*a*. The bezel 20*b* is attached to the body 20*a* by four screws 32 (FIG. 1) so as to fix a shield (glass) 33, dial 34 and others.

An annular elastic shock absorber 35 made of synthetic resin is interposed between the inner middle 20 and the outer middle 21. Both middles are fixed at four circumferential positions by radially disposed fixing screws 36 as fixing members. An overhang portion of the shock absorber 35 is engaged with a shoulder portion 39 of the outer middle 21 so that the shock absorber is not displaced nor disengaged although a shock may be applied to the outer middle.

Each fixing screw 36 comprises a head 36*a*, large diameter screw thread portion 36*b*, small diameter and portion 36*c* as shown in FIG. 5. The large diameter screw thread portion 36*b* functions as the fixing means of the fixing screw 36. The screw thread portion 36*b* engages a screw thread of the outer middle 21 and the end portion 36*c* penetrates through the shock absorber 35 and is inserted in and engages a cup-shaped shock absorber 38 embedded in a hole 37 of the inner middle 20. The shock absorber 38 may be a cylinder without a bottom.

Figure 7:
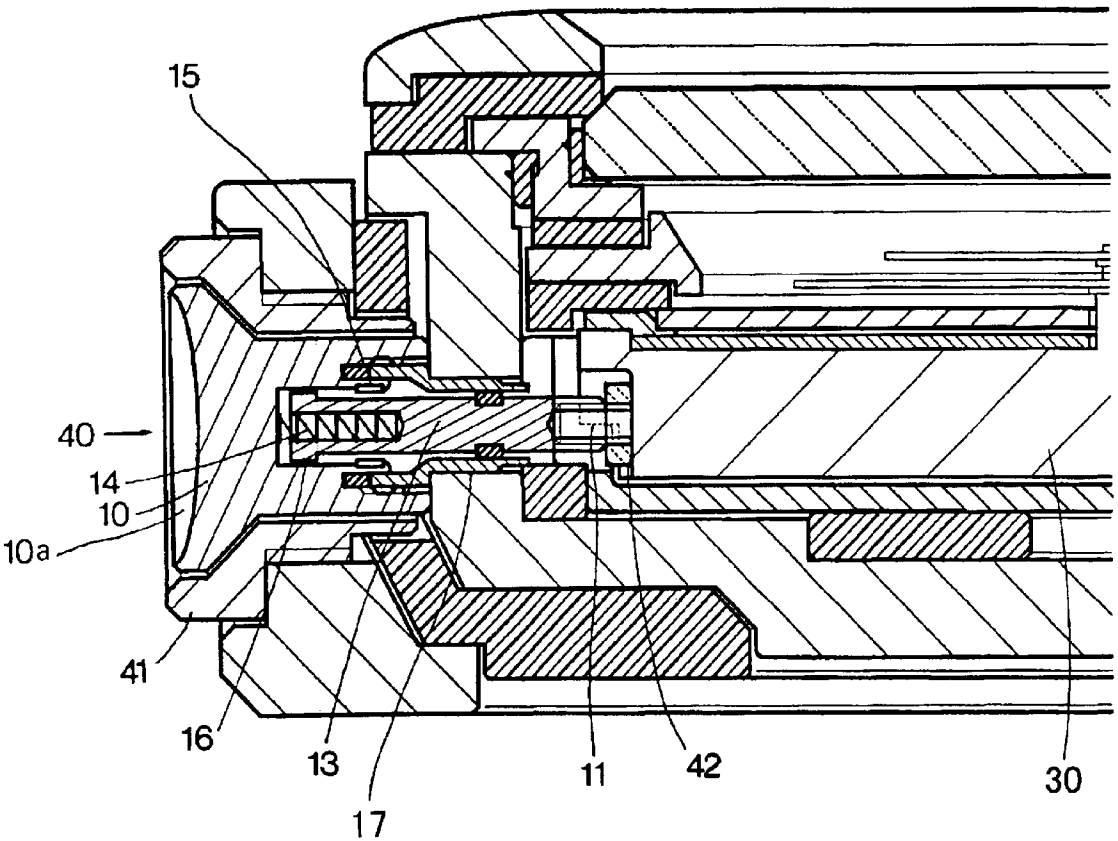
FIG. 7 is a sectional view taken along a line VII—VII of FIG. 1.
Figure 8:
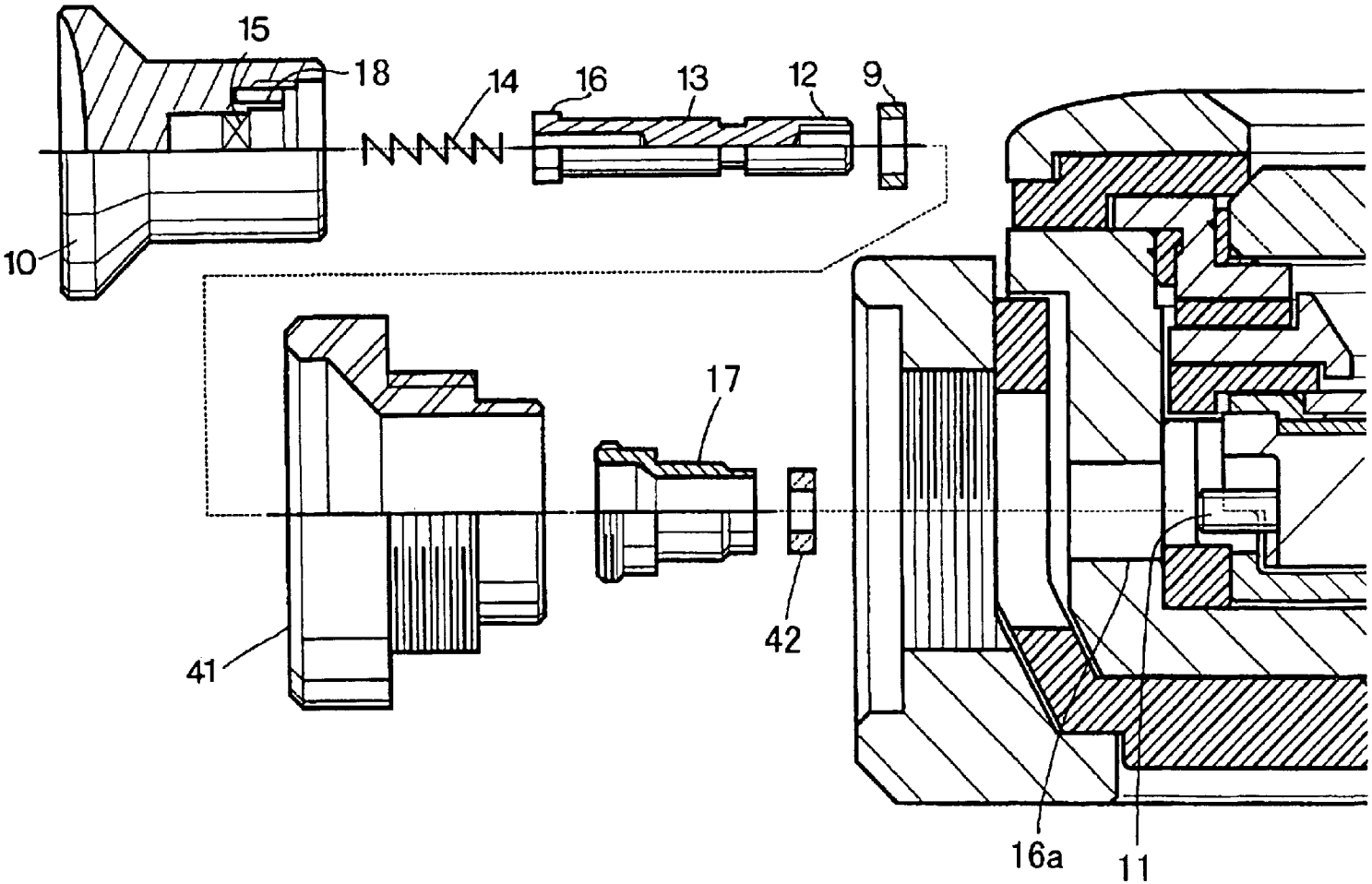
FIG. 8 is an exploded view of FIG. 7.
Figure 48:
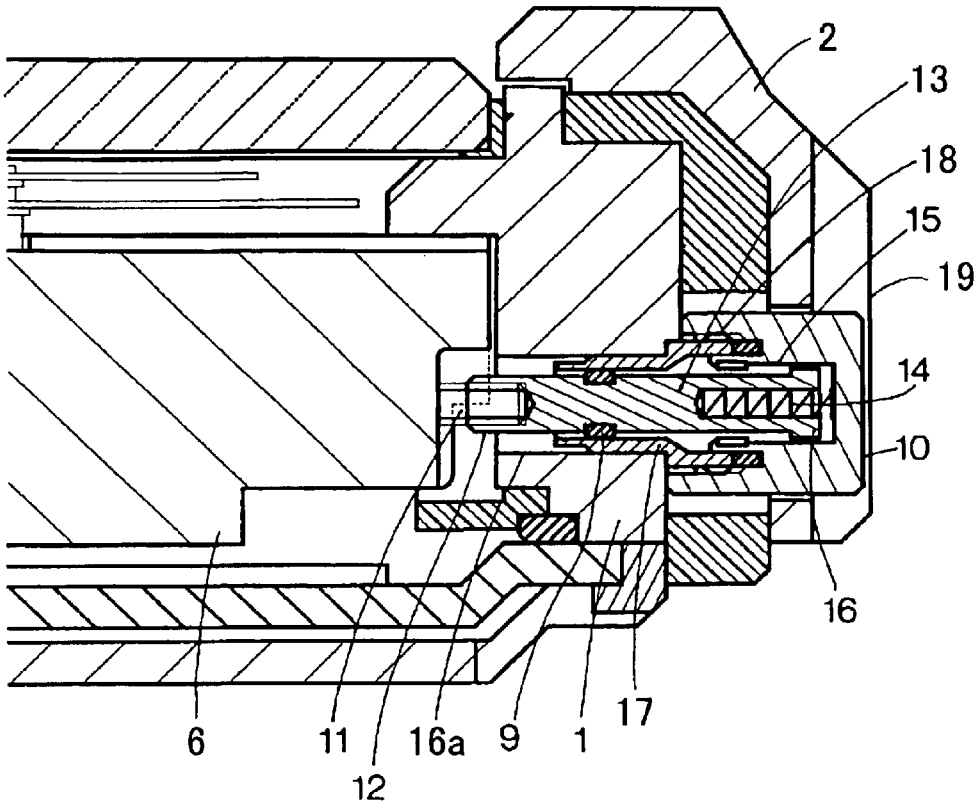
FIG. 48 is a sectional view of a conventional watchcase employing a screw-lock crown.

As shown in FIG. 7, the present watchcase employs a screw-lock crown 40. The crown has the identical structure as the conventional crown shown in FIG. 48. The same parts in FIG. 7 are designated by the same reference numerals as those in FIG. 48 thereby omitting the descriptions thereof. The crown differs from that of FIG. 48 in that the crown head 10 is slidably and rotatably supported in a guard pipe 41 which is engaged with and fixed in the outer middle 21, and in that a recess 10*a* is formed on the surface of the head so as to be able to rotate the head with a coin.

In accordance with the present invention, a metallic annular axial movement restricting member 42 is disposed between the stem connecting member 13 and the movement 30 so as to surround the stem 11. In addition, the outer periphery of the crown head 10 is positioned at a position inner than the outer periphery of the guard pipe 41 when the crown head 10 is fixed to the support pipe 17 by the screw 18.

Figure 9:
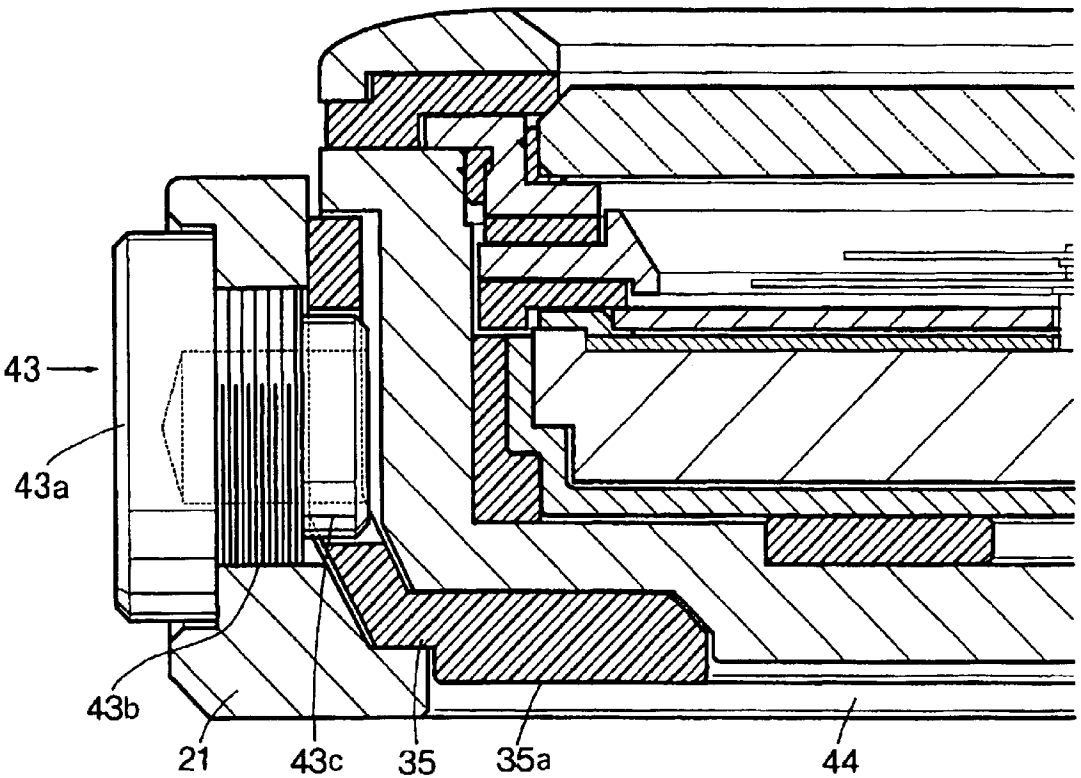
FIG. 9 is a sectional view taken along a line IX—IX of FIG. 1.
Figure 10:
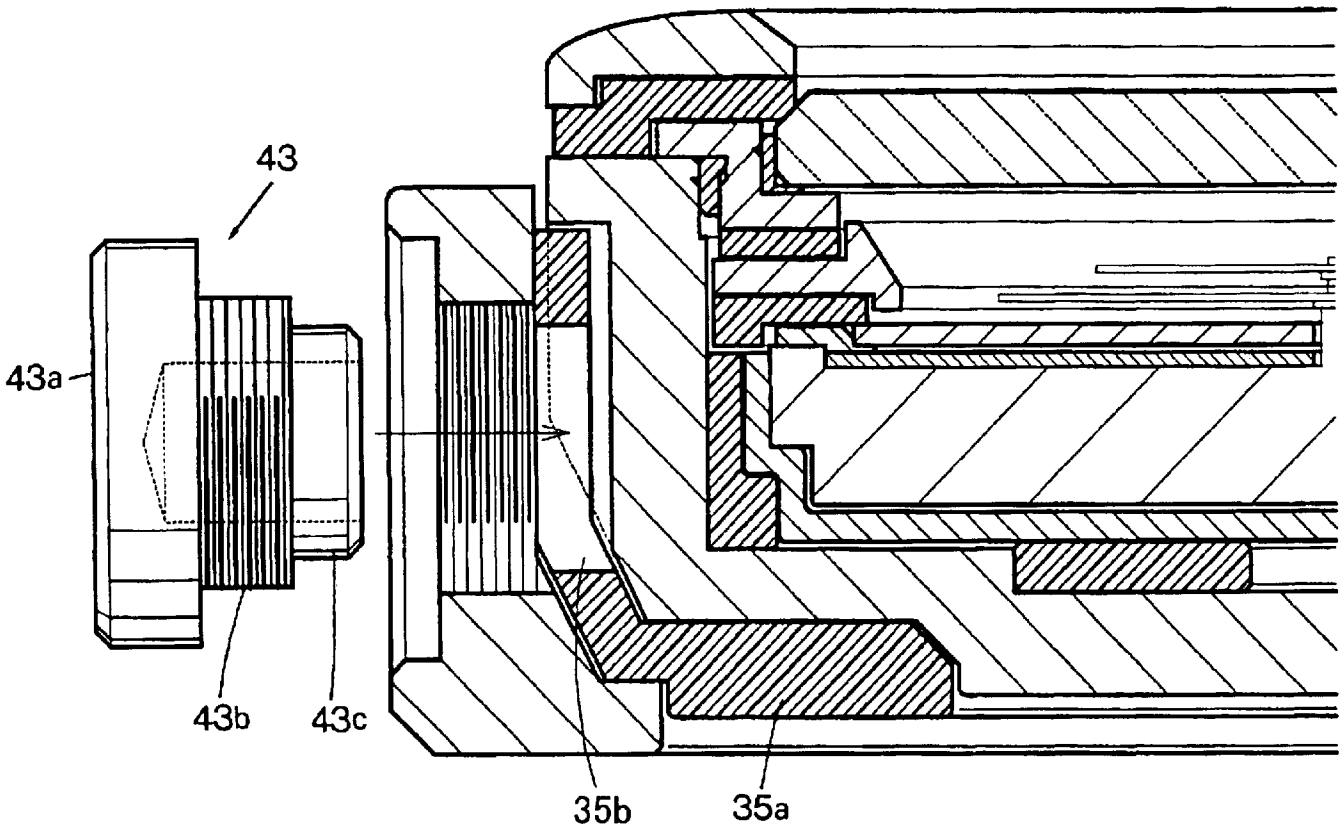
FIG. 10 is an exploded view of FIG. 9.
Figure 11:
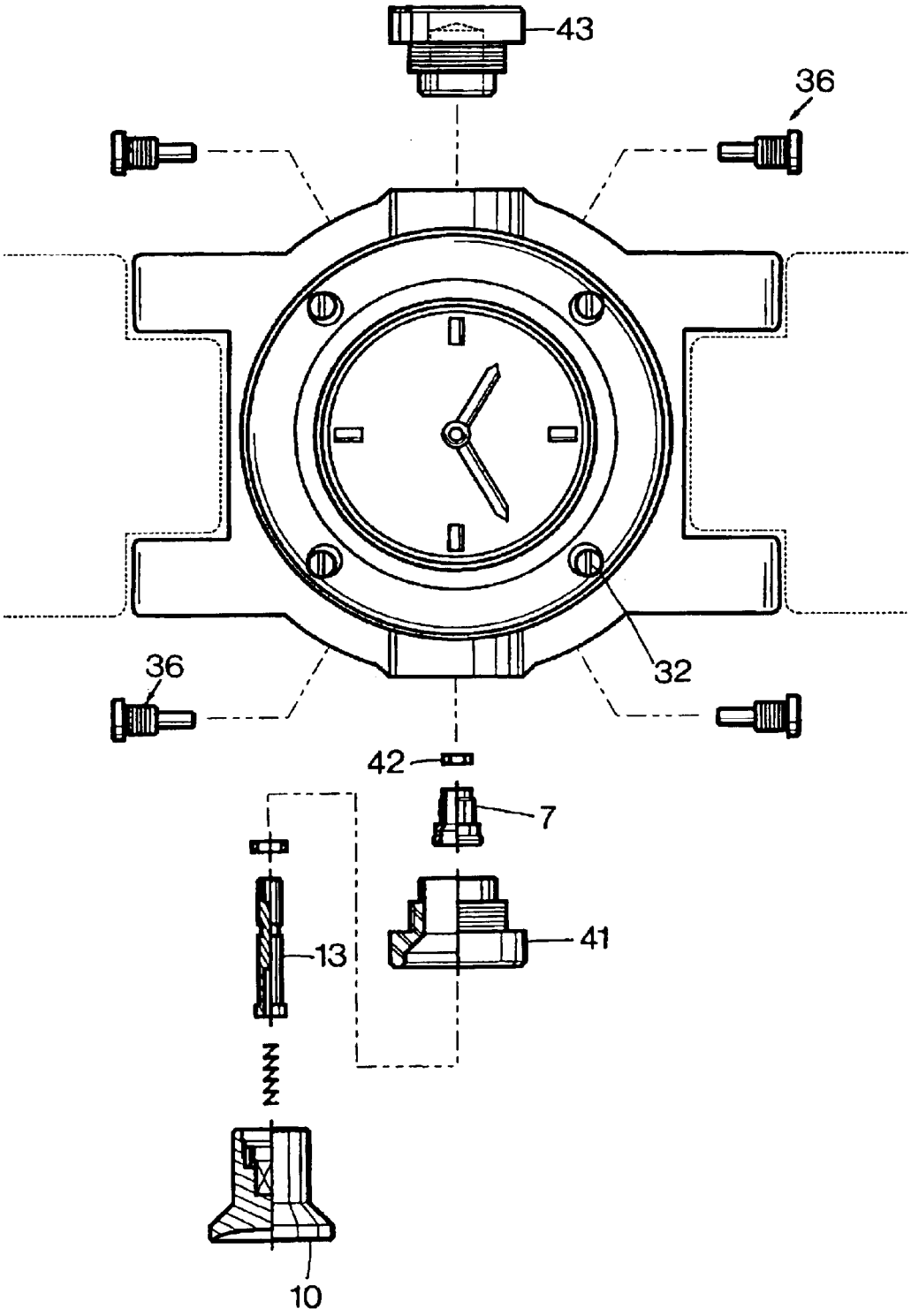
FIG. 11 is an exploded plan view of a watchcase according to the present invention.
Figure 12:
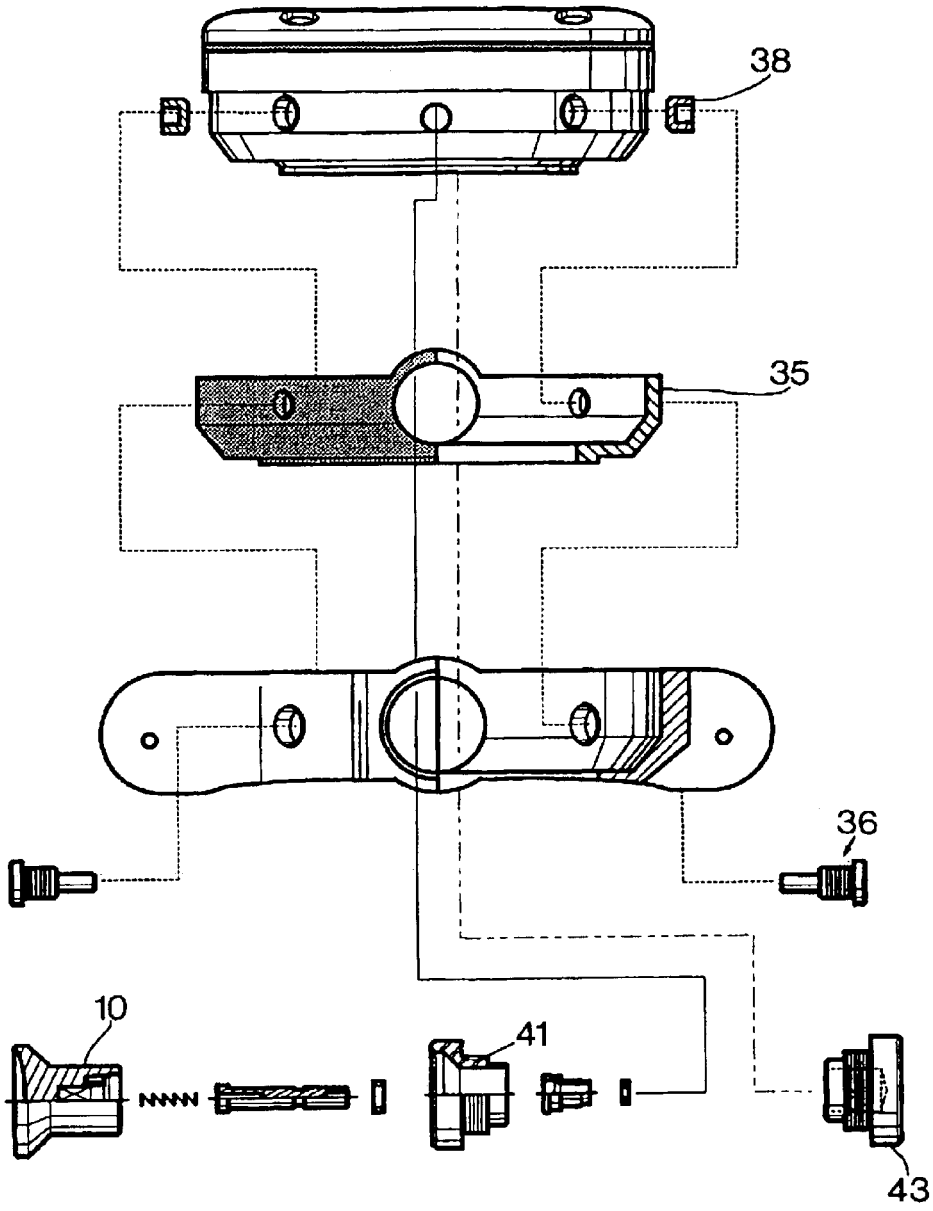
FIG. 12 is an exploded side elevational view of the watchcase.
Figure 13:
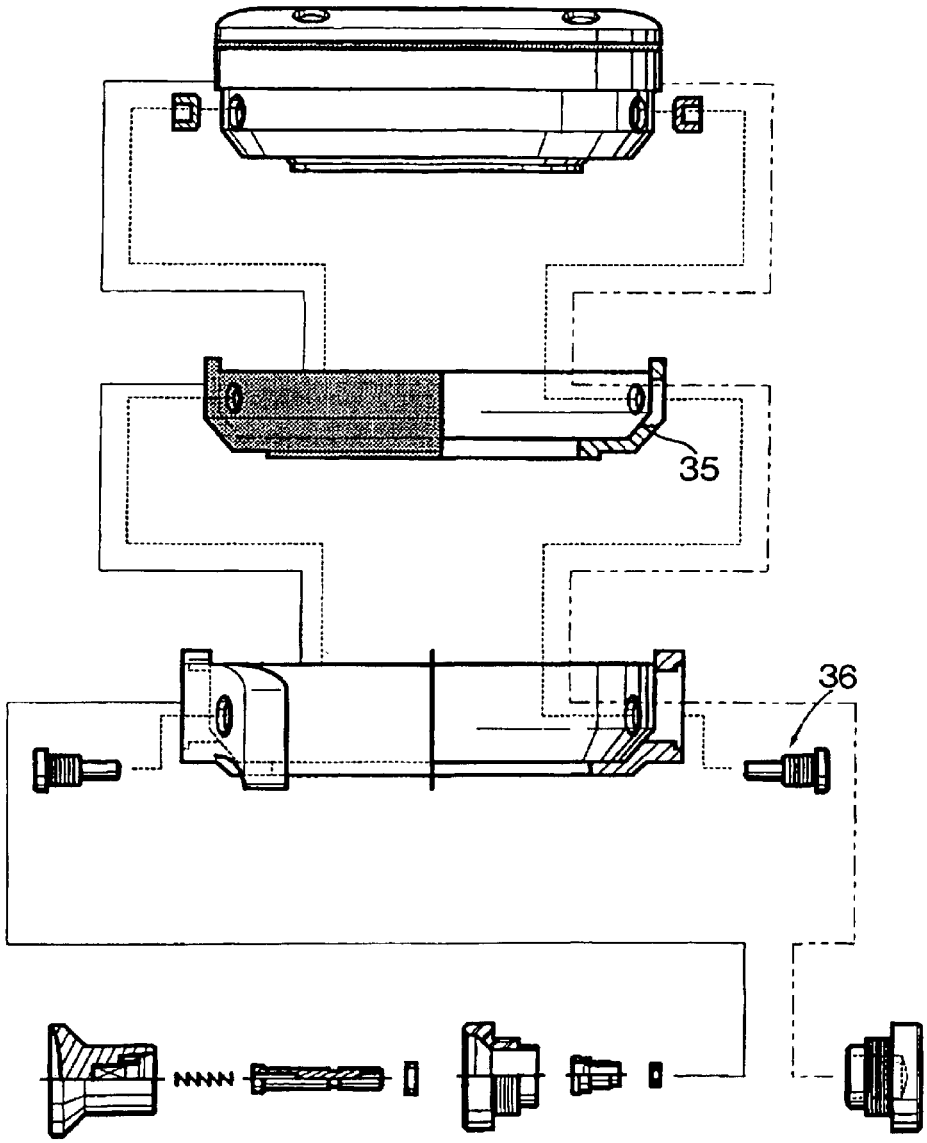
FIG. 13 is an exploded side elevational view as viewed from the other side of FIG. 12.

On the other side of the screw-lock crown 40, there is provided an engaging member 43 (FIG. 1). The engaging member 43 comprises, as shown in FIG. 9, a head 43*a*, large diameter screw thread 43*b*, and a small diameter end portion 43*c*. The screw thread 43*b* engages the outer middle 21 while the end portion 43*c* engages a hole 35*b* (FIG. 10) of the shock absorber 35.

Referring to FIG. 5, an opening 44 is formed in the bottom of the outer middle 21 through which a bottom 35*a* of the shock absorber 35 is disclosed. In addition, a part of the shock absorber 35 covers a part of the bottom of the inner middle, and further protrudes therefrom. The engagement of the bottom 20*c* protruding from the inner middle 20 with the shock absorber 35 prevents the shock absorber from disengaging or moving. The engagement at the shoulder 39 may be designed so that the shoulder and the overhang are inverted. That is, the shock absorber may be provided with a projection inserted in a recess of the outer middle.

Since the outer middle 21 is made of metal, such inconveniences as injury, abrasion and others which are caused by contacts or collisions with external foreign substances can be prevented.

The fixing screw 36 for attaching the outer middle 21 and the inner middle 20 together is screwed in the outer middle 21, and the end portion 36*c* thereof is engaged within the shock absorber 38 inserted in the hole 37 of the inner middle 20. As a result, although a shock may be externally applied to the fixing screw, the shock is not transmitted to the inner middle, thereby preventing the movement disposed in the inner middle from breaking.

Moreover, the annular movement restricting member 42 (FIG. 7) is disposed between the stem connecting member 13 of the screw-lock crown and the movement 30. Consequently, although a shock may be applied to the crown head 10, the connecting member 13 is not displaced hence being prevented from pushing the stem thereby to break the members provided in the movement. Since the outer periphery of the crown head 10 is positioned inner side of the outer periphery of the guard pipe 41, the shock is not directly applied to the head. Thus the stem is prevented from breaking due to the shock.

In addition, since the bottom 35*a* of the shock absorber 35 exists in the opening 44 of the outer middle 21, and further protrudes out of the bottom of the inner middle, a shock which is applied to the inner middle when the case is dropped can be absorbed. Moreover, since the shock absorber 35 flexibly contacts the wrist, the wearing feeling is improved.

Furthermore, the end portion 43*c* of the engaging member 43 (FIG. 10) engages the hole 35*b* of the shock absorber 35, so that the shock absorber is neither displaced nor disengaged.

Although the fixing means is a screw in the above described embodiment, other known means such as adhesion, press fit, brazing and welding may be employed as the fixing means.

Moreover, although a flexible material such as polyurethane is preferable as the shock absorber, any material will suffice as long as it is capable of absorbing a shock. For example, a metal coil spring may be used.

Figure 14:
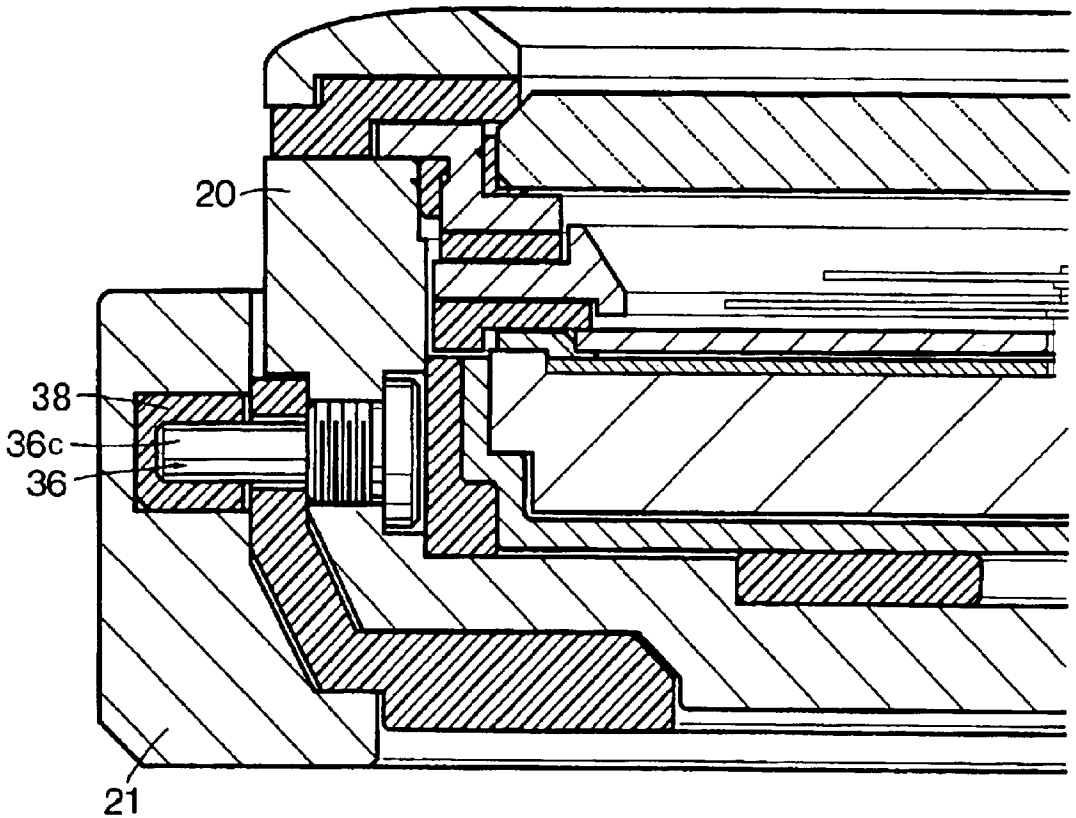
FIG. 14 is a sectional view of a second embodiment of the present invention taken along the same section line as that of FIG. 5.

FIG. 14 shows the sectional view of the second embodiment of the present invention.

In the present embodiment, the fixing screw 36 is screwed in the screw thread of the inner middle 20 from within the inner middle, and the cup-shaped shock absorber 38 is inserted in a hole of the outer middle 21 and the small diameter end portion 36*c* is engaged with the shock absorber.

The shock applied from the outer middle 21 can likewise be restrained by the shock absorber 38 in the present example.

Figure 15:
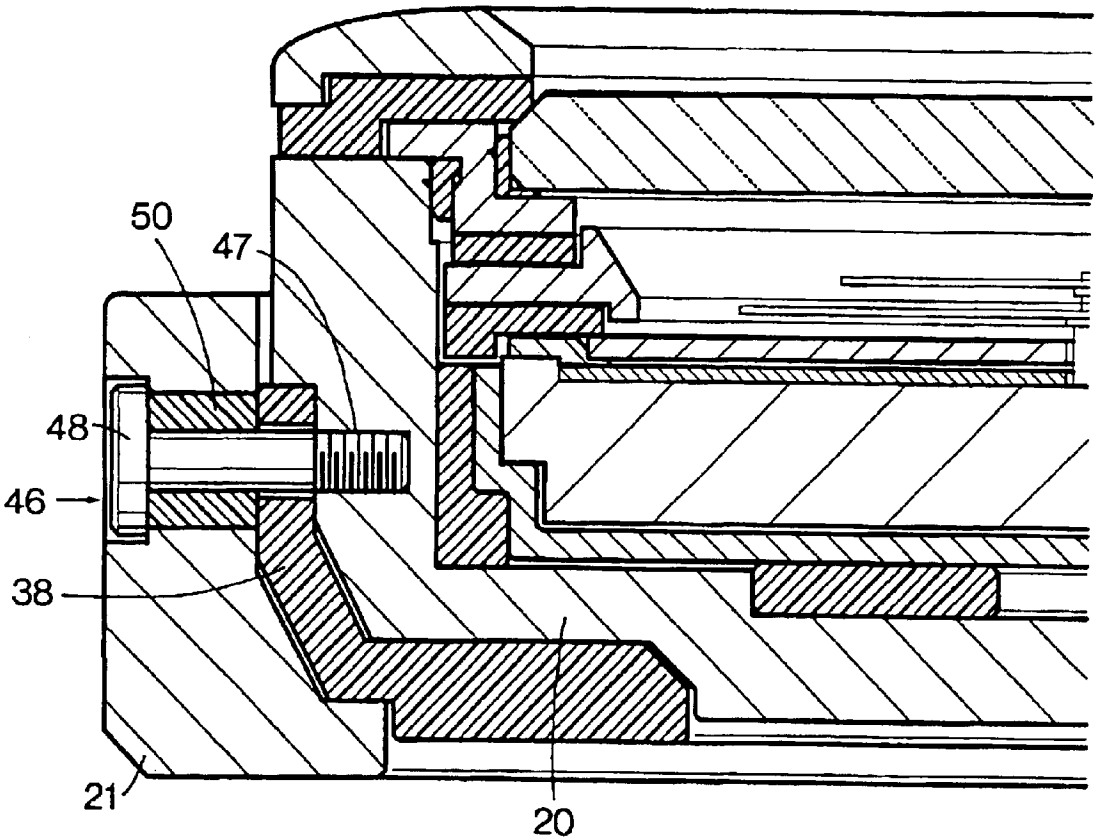
FIG. 15 is a sectional view of a third embodiment of the present invention taken along the same section line as that of FIG. 5.

FIG. 15 shows the sectional view of the third embodiment of the present invention. In the embodiment, a fixing screw 46 has a body of uniform diameter and a screw thread 47 thereof is engaged with the screw thread formed in the inner middle 20. A cylindrical shock absorber 50 is disposed between a head 48 and the shock absorber 38.

In the present embodiment, the shock absorber 50 restrains the shock applied to the outer middle 21.

Figure 16:
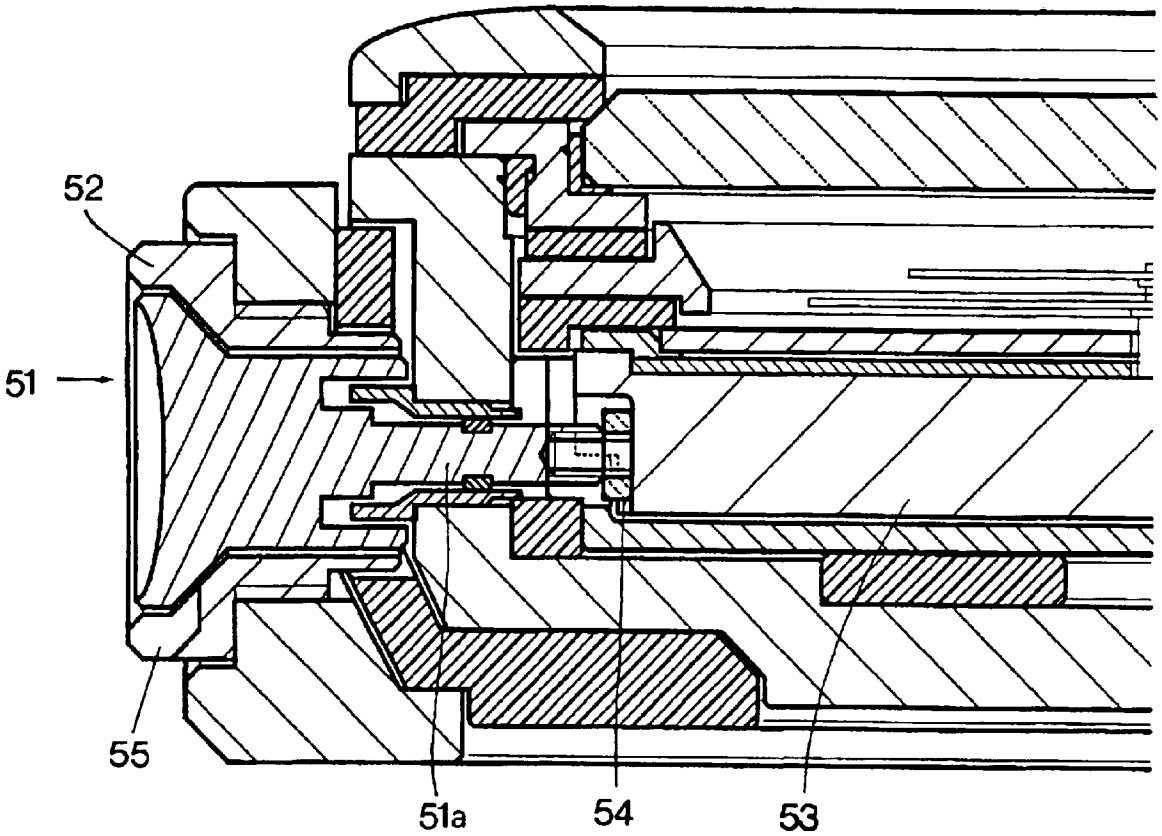
FIG. 16 is a sectional view of a fourth embodiment of the present invention taken along the same section line as that of FIG. 7.

FIG. 16 shows the fourth embodiment wherein an ordinary crown 51 is used. The crown 51 is housed in a guard pipe 52 having the outer periphery thereof at a position inner than the outer periphery of the guard pipe. A shock absorber 54 is disposed between an end of a stem connecting portion 51*a* of the crown 51 and a movement 53, so that the members in the movement are prevented from injury. A recess 55 is formed in the guard pipe 52 so that finger tips may be inserted therein to pull out the crown 51 to adjust time.

Figure 17:
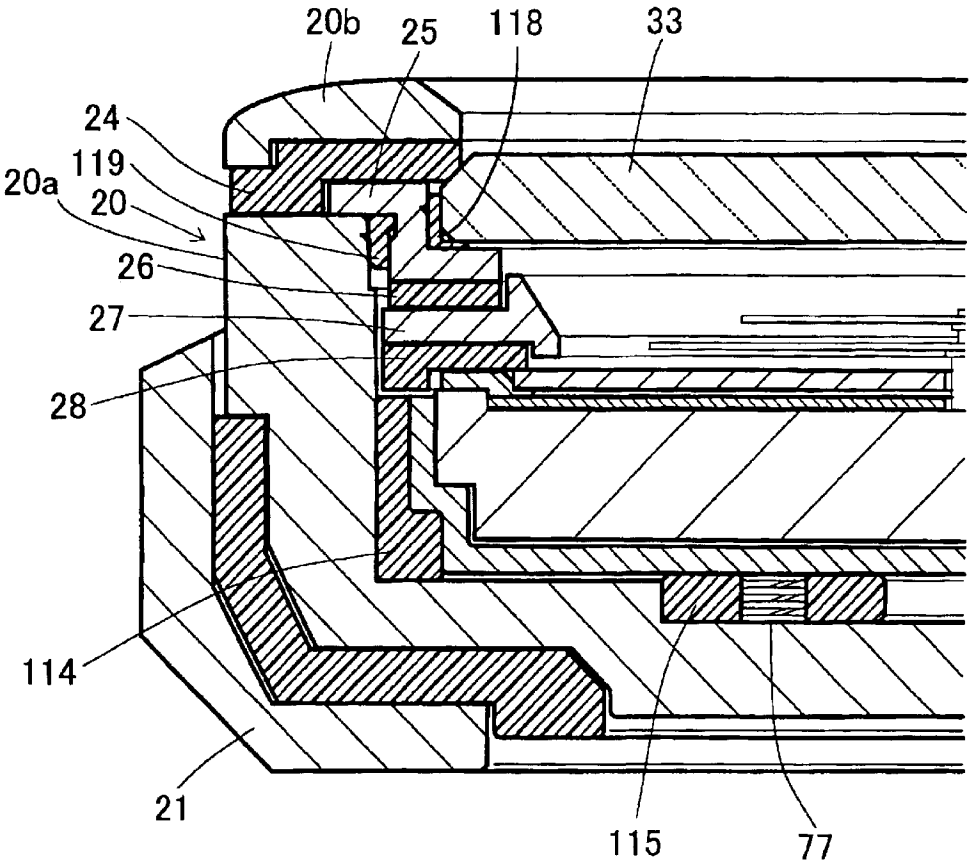
FIG. 17 is a sectional view of a fifth embodiment of the present invention taken along a section line intersecting a spring.

FIG. 17 shows the sectional view of the fifth embodiment of the present invention. The present embodiment is identical in appearance with the first embodiment. The same parts in the present embodiment as those in the first embodiment are designated by the same reference numerals, thereby omitting the descriptions thereof.

Figure 19:
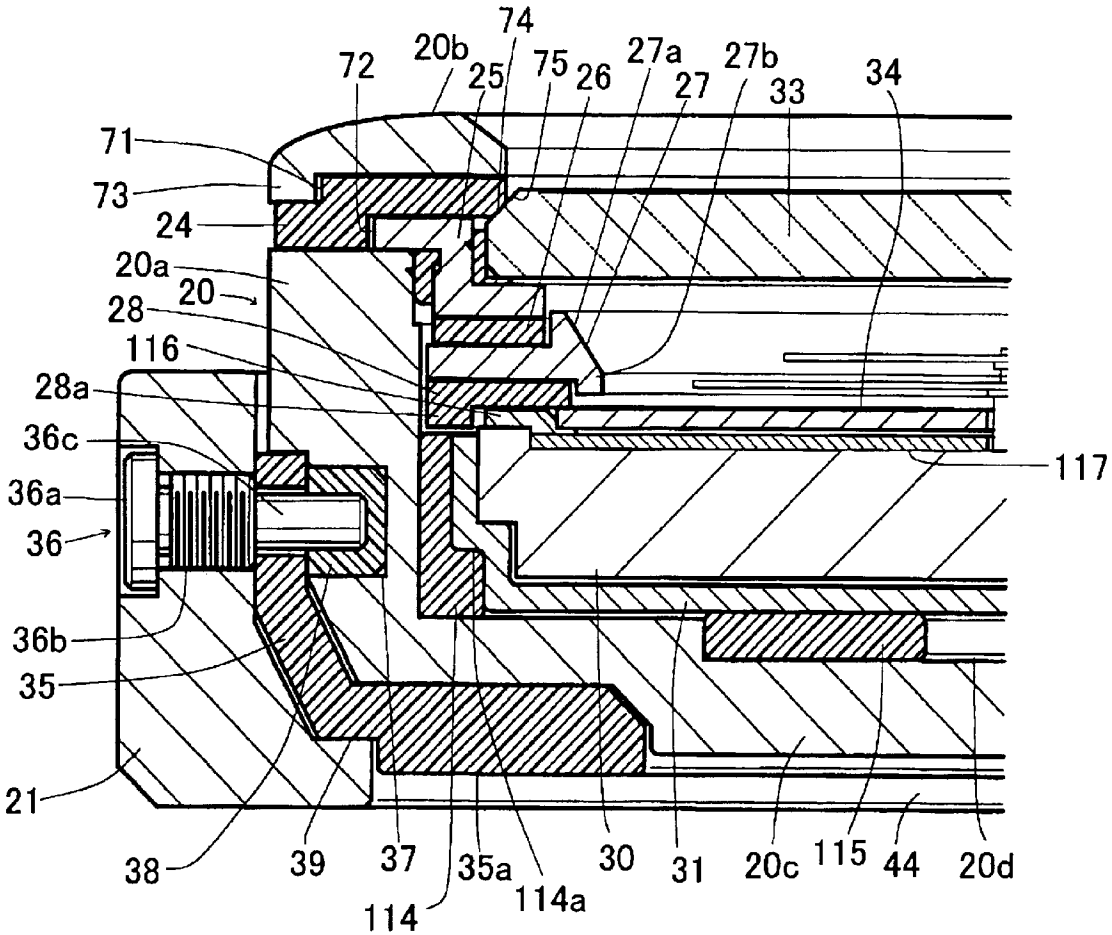
FIG. 19 is a sectional view taken along the same section line as that of FIG. 5.
Figure 20:
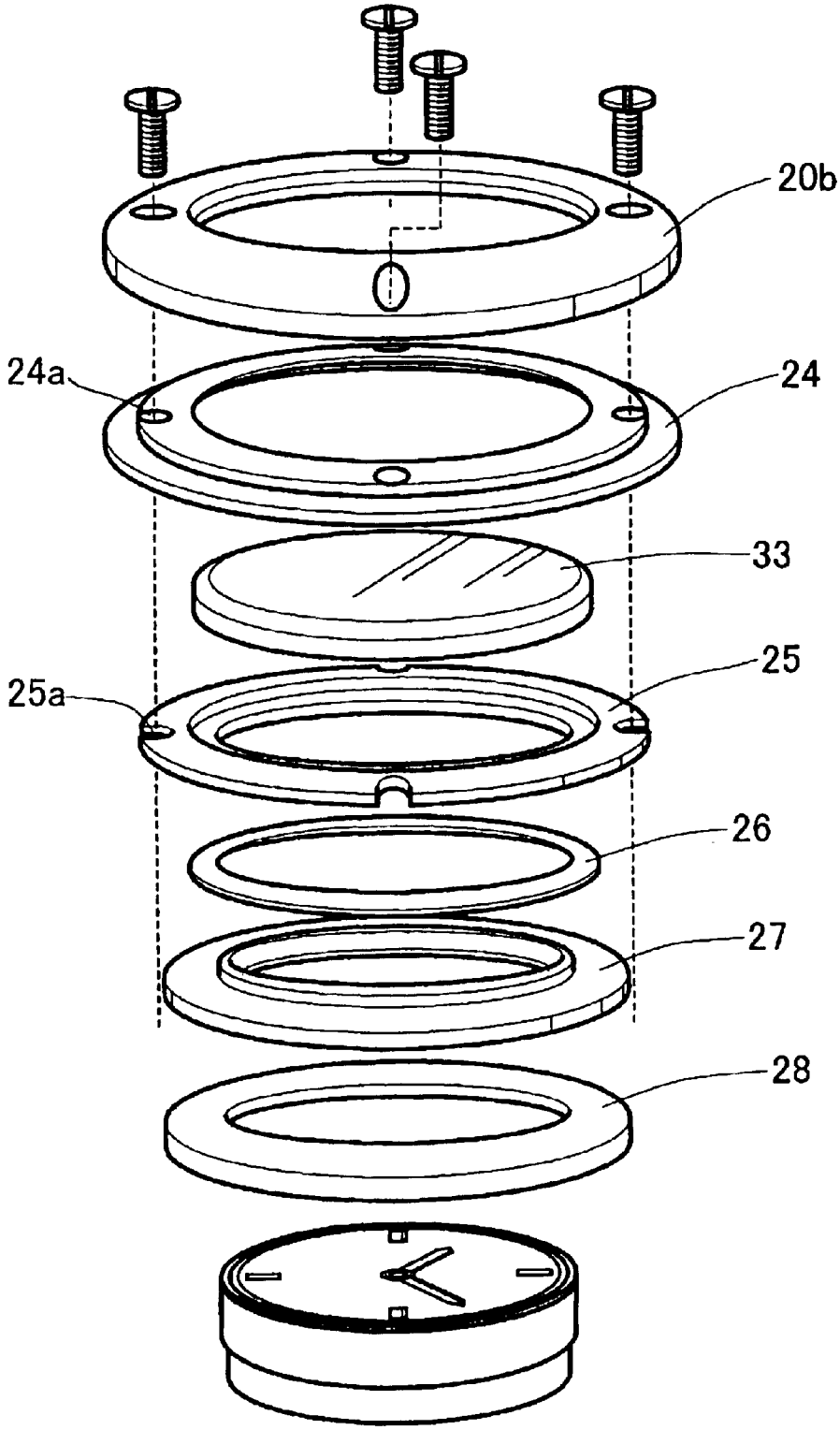
FIG. 20 is an exploded perspective view.
Figure 21:
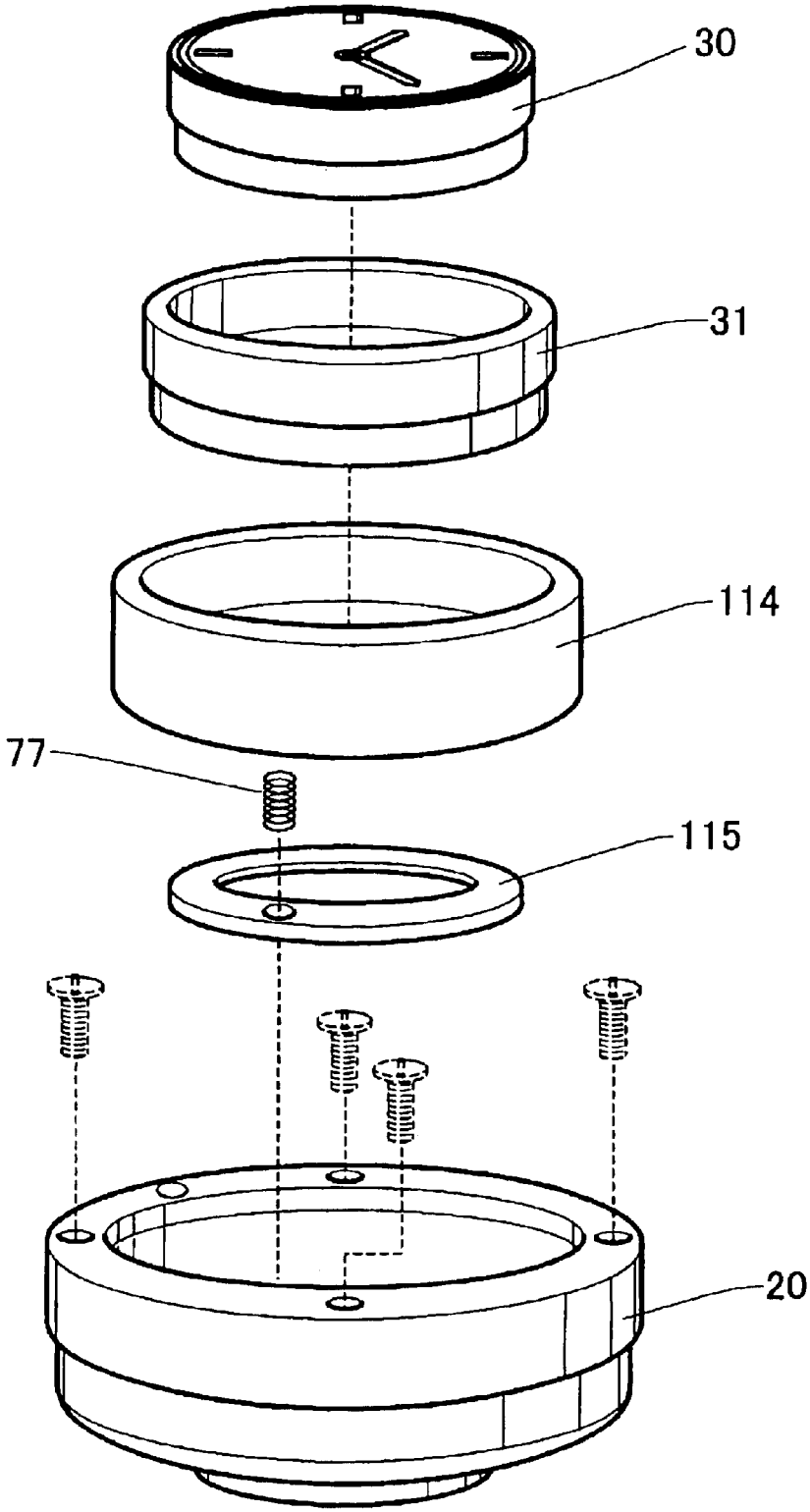
FIG. 21 is an exploded perspective view.
Figure 22:
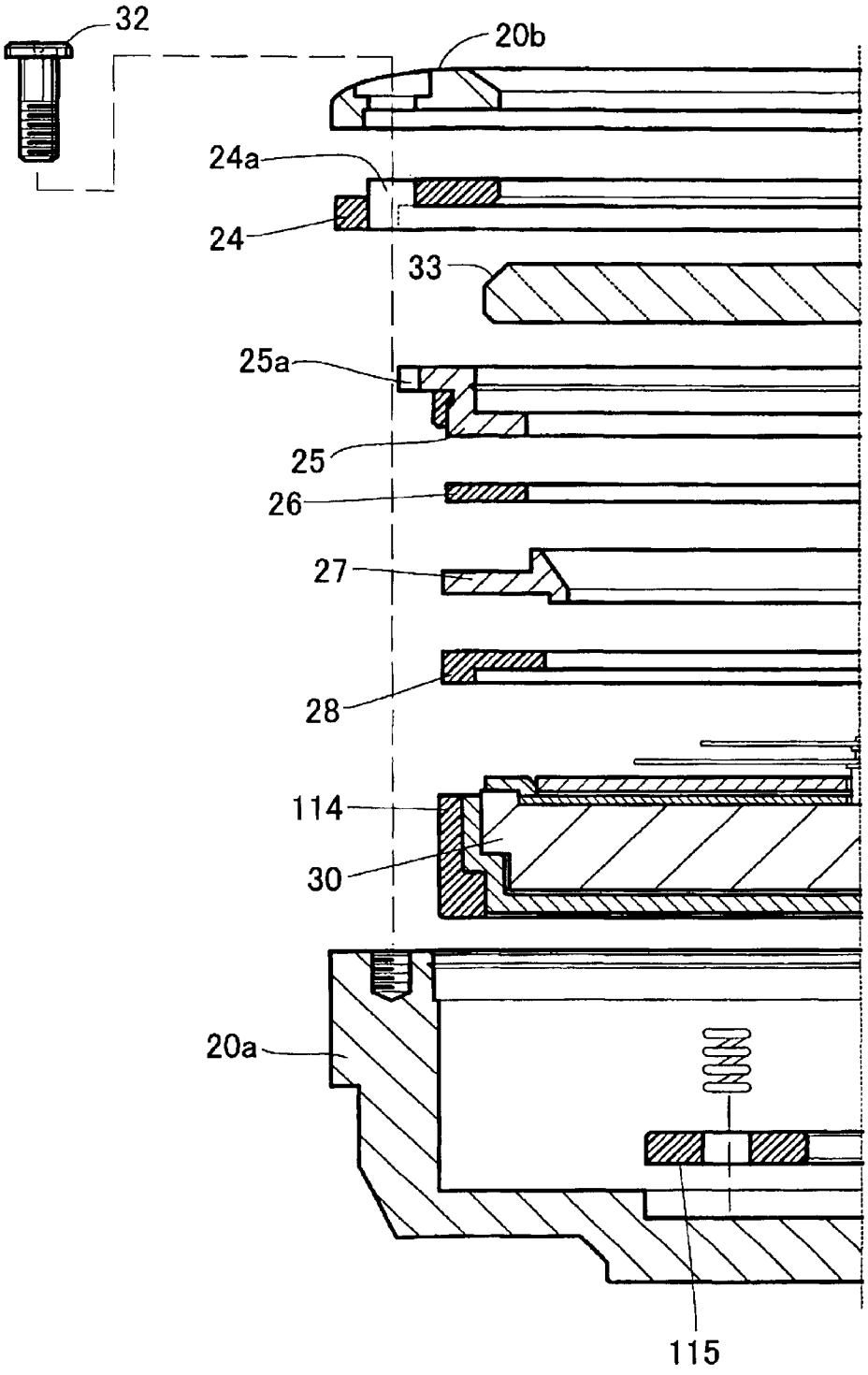
FIG. 22 is an exploded sectional view.

The inner middle 20 comprises the body 20*a*, bezel 20*b* and the bottom 20*c* as shown in FIG. 19. The movement 30 is mounted on the bottom 20*c* interposing an annular elastic bottom shock absorber 115 made of synthetic resin and a magnetic shielding member 31. A cylindrical shock absorber 114 is disposed between the periphery of the shielding member 31 and the body 20*a*.

On the movement 30, there are sequentially mounted a solar cell 117, and interposing a dial fixing portion 116 of the movement, the dial 34, shock absorber 28 for the movement, ornamental ring 27, shock absorber 26 for the ornamental ring, shield holding ring 25 made of magnetic shielding material, top shock absorber 24 and the bezel 20*b*. Moreover, the shield 33 is fixed on the holding ring 25 interposing a watertight shield-fixing seal 118 (FIG. 17). A watertight fixing seal 119 (FIG. 17) is interposed between the outer periphery of the holding ring 25 and the body 20*a* of the inner middle.

Figure 18:
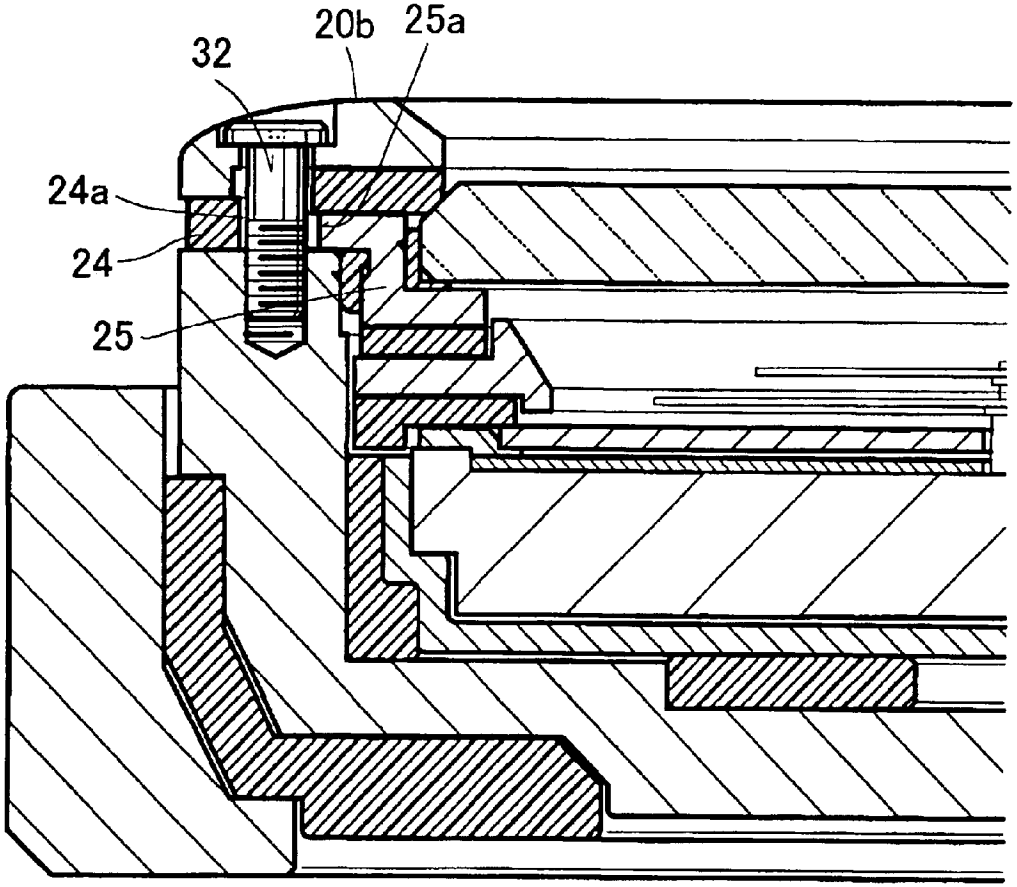
FIG. 18 is a sectional view taken along a section line intersecting a screw for supporting a bezel.

As shown in FIG. 18, the bezel 20*b* is fixed to the body 20*a* of the inner middle 20 by four screws 32. Each screw 32 penetrates a corresponding hole 24*a* formed in the top shock absorber 24 and engages a recess 25*a* formed along the periphery of the holding ring 25.

The shock absorber 24 has a width extended to cover the entire underside of the bezel, and is provided with an outer peripheral upper step 71 (FIG. 19) and inner peripheral lower step 72. The step 71 engages with an annular outer peripheral lower projection 73 of the bezel and the step 72 engages with the outer peripheral edge of the holding ring 25. A slant 74 is formed along the inner peripheral edge of the shock absorber 24 and abuts on a slant 75 formed along the outer peripheral edge of the shield 33.

The movement shock absorber 28 has a downwardly extending step 28*a* with which the dial fixing portion of the movement is engaged.

In accordance with the construction, if a shock is applied to the bezel 20*b* from above, the shock absorber 24 prevents the shock from transmitting to the inner middle 20, movement 30 provided therein, and other parts. On the other hand, if a shock is applied to the bezel in the radial direction thereof, the shock is absorbed at the step 71 of the shock absorber 24, thereby protecting the shield 33 and other parts.

In addition, a shock, which is applied to the shield 33 in the axial or radial direction thereof, is received at the slant 74 of the shock absorber 24, thereby preventing the displacement of the shield. With respect to the radial shock, the shock absorber absorbs the external force by way of the holding ring 25 so that the shield is protected. Since the screws 32 are engaged with the recess 25*a* of the holding ring 25, the deflection of the members is prevented.

The shock absorber 26 for the ornamental ring prevents the holding ring 25 from crashing against the ornamental ring 27 due to the shock applied to the shield 33, which may result in breaking of either member or the shield itself. Moreover, the shock absorber 26 prevents the transmission of shock exerted on the bezel 20*b* to the movement 30.

On the other hand, the ring 27 has upward and downward extensions 27*a* and 27*b*, which conceal the shock absorbers 26 and 28, respectively. More particularly, the extension 27*a* is extended to the position adjacent the shield receiver so that the shock absorber is concealed from outside. In addition, although a radial shock may be applied, the extension 27*a* abuts against the shock absorber 26, thereby preventing the ring from breaking.

The shock absorber 28 for the movement prevents the axial shock from being transmitted to the movement 30 and further, the ring 27 from abutting against the movement. Moreover, the shock absorber 28 abuts against the upper circumference of the dial 34 to hold the dial.

The cylindrical shock absorber 114 absorbs the external force exerted on the outer middle 21 and the inner middle 20 to prevent the transmission thereof to the movement. A step 114*a* holds the movement interposing the magnetic shielding member 31.

The downward extending step 28*a* of the shock absorber 28 for the movement receives the shock exerted on the movement in the radial direction thereof, thereby to protect the movement.

The bottom shock absorber 115, which is disposed in a recess 20*d* formed in the bottom 20*c*, absorbs an axial shock so as to protect the movement. The inner wall of the recess 20*d* prevents displacement and deformation of the shock absorber 115.

Furthermore, a spring 77 (FIG. 17) for grounding penetrates through the shock absorber 115 and is connected to the inner middle 20. Hence the spring 77 is not disengaged.

Thus in accordance with the present embodiment, parts in the watchcase, especially the movement and the shield, are protected from various shocks so that accidents can be prevented.

Figure 23:
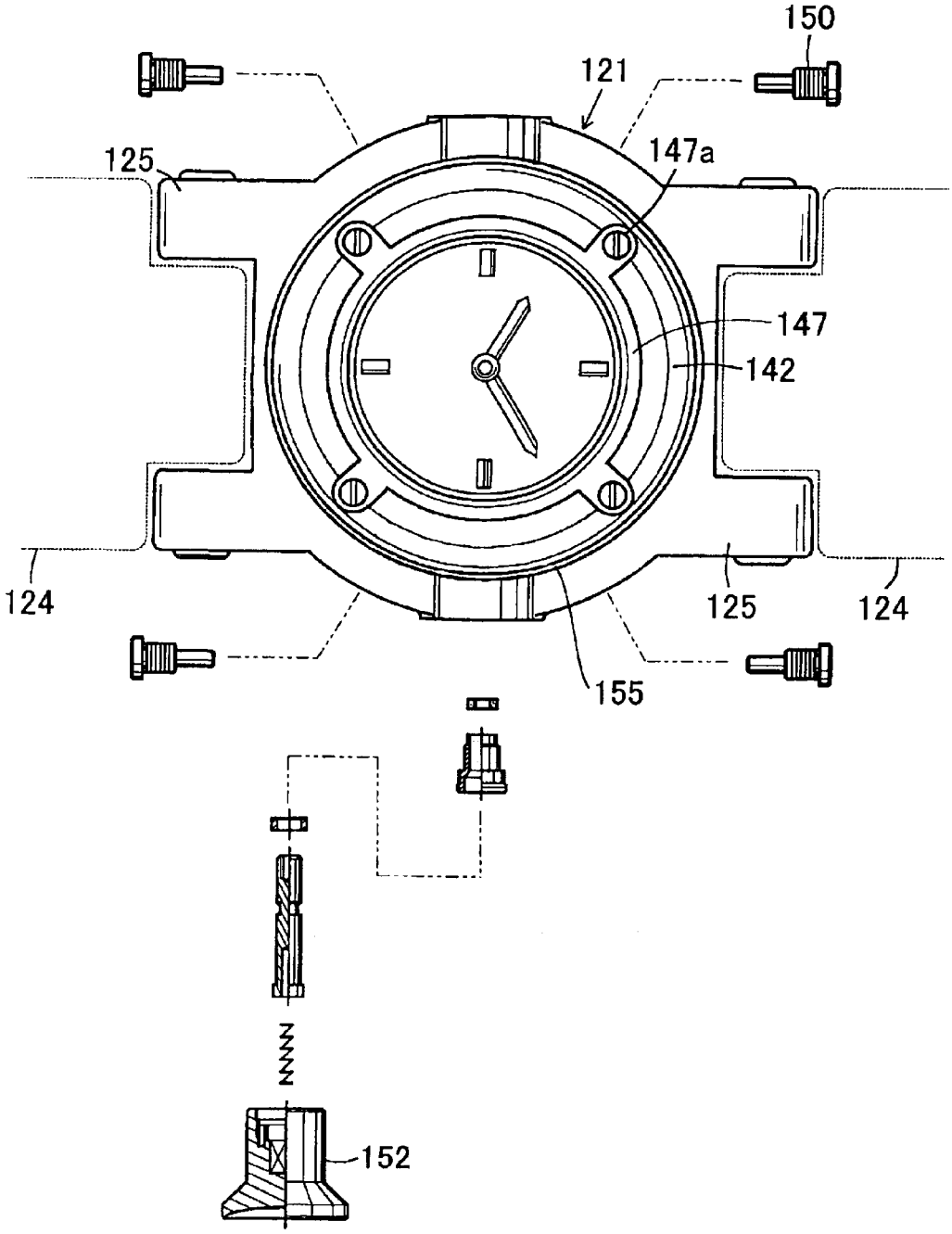
FIG. 23 is an exploded plan view of a sixth embodiment of the present invention.
Figure 24:
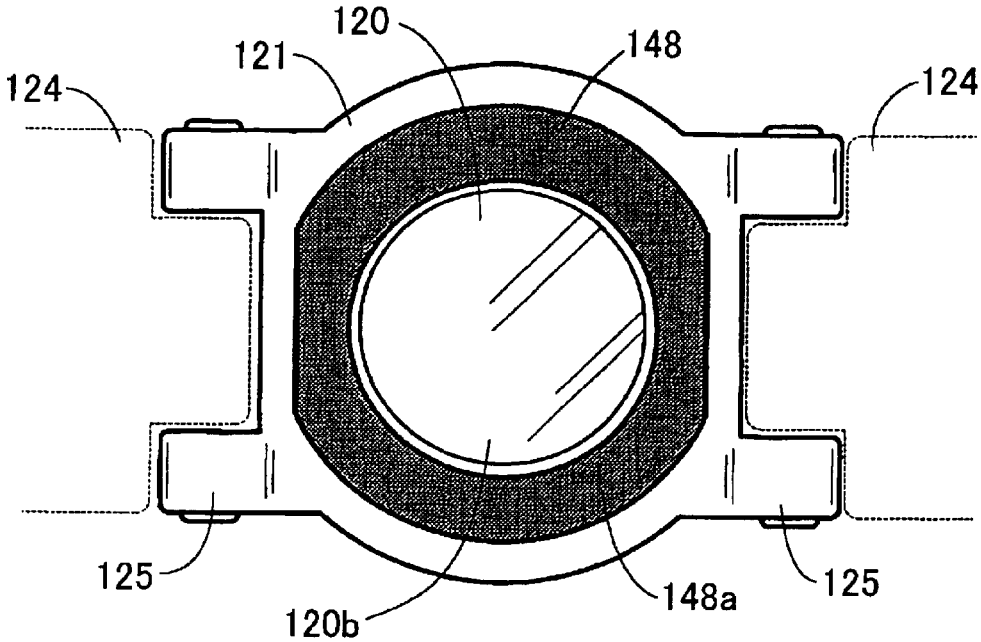
FIG. 24 is a rear view of the sixth embodiment.
Figure 25:
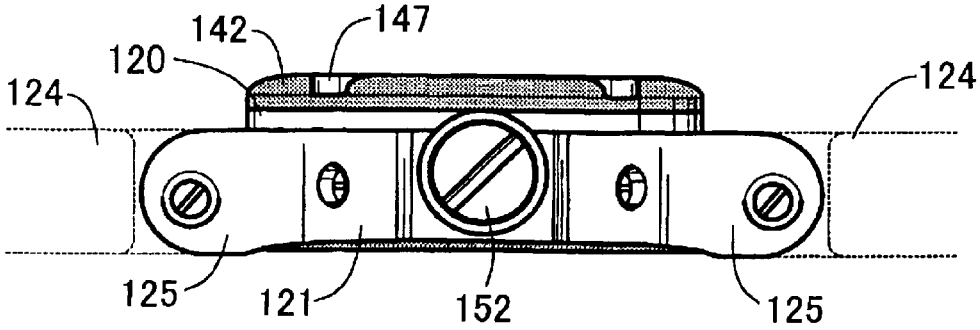
FIG. 25 is an elevational view of the sixth embodiment.

FIG. 23 shows the plan view of the sixth embodiment of the present invention, FIG. 24 shows the rear view thereof, FIG. 25 shows the elevational view thereof, and FIGS. 26 through 29 show sectional views of various parts.

Figure 26:
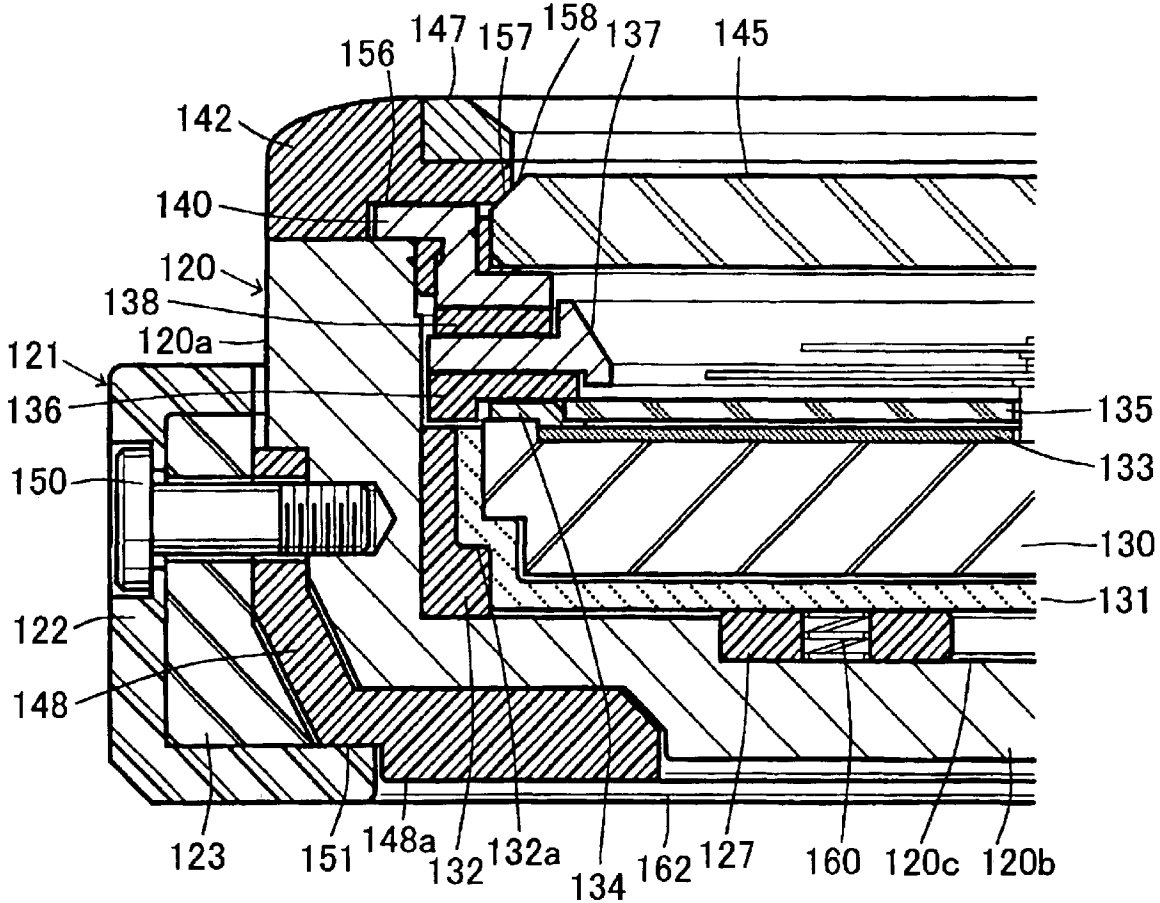
FIG. 26 is a sectional view taken along the same section line as that of FIG. 5.

As shown in FIG. 26, the watchcase according to the present embodiment comprises a metallic inner middle 120 and an outer middle 121 made of synthetic resin. The outer middle 121 comprises an outer shell 122 made of a soft synthetic resin such as polyurethane and an inner shell 123 made of a hard synthetic resin such as polycarbonate. The inner and outer shells are integrally molded by dissimilar material molding (two color molding). The method of integrally molding of the inner and outer shells is described as follows.

First of all, hard synthetic resin such as polycarbonate is injected into a metal mold for primary molding, thereby to form the inner shell. The primary metal mold is then removed and a metal mold for secondary molding is attached so that the inner shell is mounted therein. Soft synthetic resin such as polyurethane is thereafter injected in the secondary metal mold. The outer surface of the inner shell made of hard synthetic resin and the injected soft synthetic resin are accordingly integrally hardened. Thus the outer shell made of soft synthetic resin is integrally formed over the outer surface of the inner shell of hard synthetic resin. Alternatively, the inner and outer shells may be integrally formed by the insert molding.

The outer shell 122 is so formed as to cover the upper, side and bottom surfaces of the inner shell 80 that the inner shell 123 is not exposed. A pair of connecting legs 125 for connecting a band 124 (FIG. 23) is formed on both sides of the outer shell 122.

Figure 28:
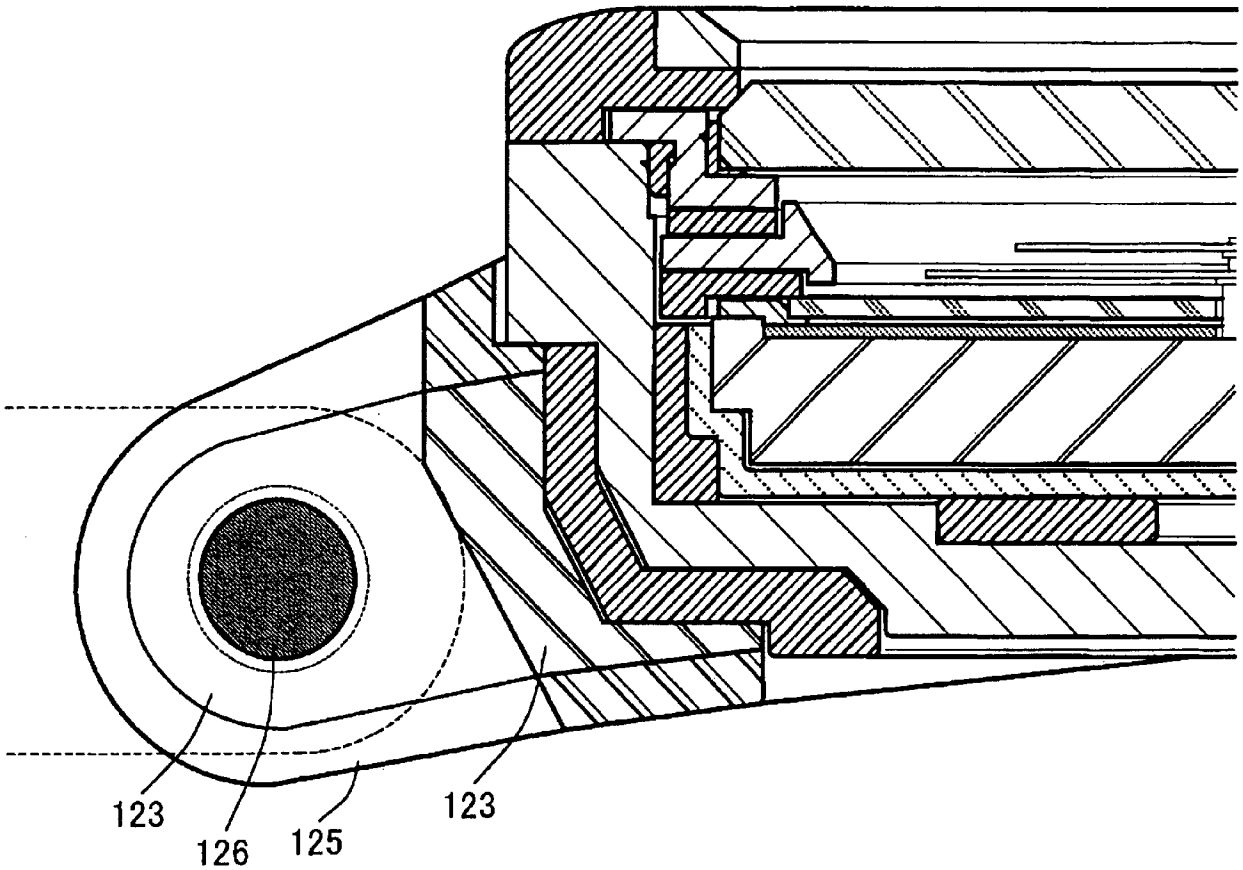
FIG. 28 is a sectional view taken along section line intersecting a bezel and a band connecting portion.

As shown in FIG. 28, the outer shell 122 is cut away at the side surface of the connecting leg opposite lateral side of the band 124 so as to expose the inner shell 123. The outer shell is also cut away at the portion of side surface of the outer middle between the pair of connecting legs so as to expose the inner shell 123. Hence, the hard inner shell is exposed to oppose the band 124 connected to the outer middle so that the soft outer shell is prevented from abrading due to the contact with the rotating bands.

A connecting hole in which a connecting pin 126 for connecting the band 124 is formed in the inner shell 123 of the outer middle so that the band is connected to the hard inner shell. Therefore, although the band may be forcibly pulled, the force for pulling the band is not exerted on the soft outer shell so that deformation and breaking of the outer shell are prevented. Moreover, when the band is pulled, since the soft inner shell does not deform or break, the band is securely connected to the outer middle.

Figure 27:
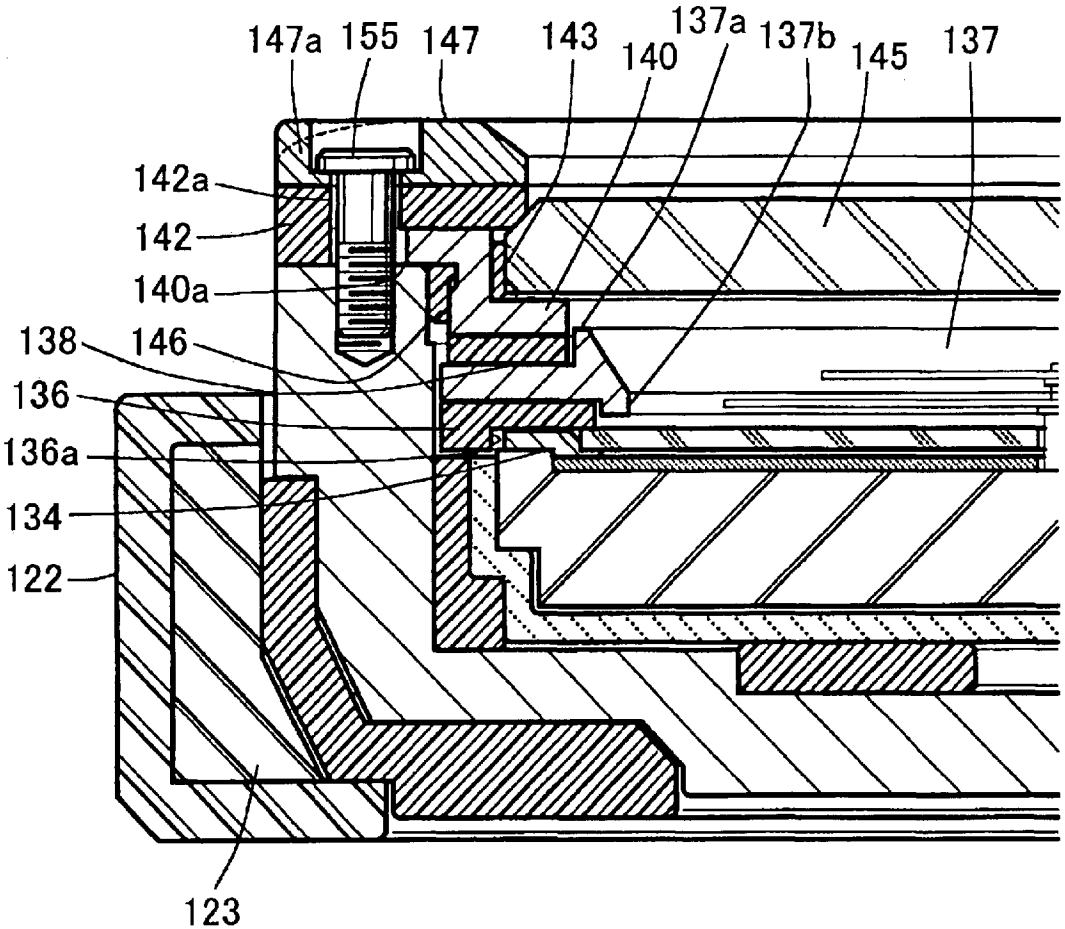
FIG. 27 is a sectional view taken along a section line intersecting-a screw for holding a bezel.

As shown in FIGS. 26 and 27, the inner middle 120 comprises a body 120*a* and a bottom 120*b*. An elastic annular bottom shock absorber 127 made of synthetic resin is disposed on the bottom 120*b* and a movement 130 is further mounted on the shock absorber interposing a magnetic shielding member 131. A cylindrical shock absorber 132 is disposed between the outer periphery of the magnetic shielding member 131 and the body 120*a*.

On the movement 130, there are sequentially mounted a solar cell 133 and interposing a dial fixing portion 134 of the movement, a dial 135, shock absorber 136 for the movement, ornamental ring 137, shock absorber 138 for the ring, shield receiver 140 made of magnetic shielding material, and a bezel 142 made of synthetic resin. Moreover, a shield 145 is fixed on the shield receiver 140 interposing a watertight shield-fixing seal 143 (FIG. 27). A watertight fixing seal 146 (FIG. 27) is interposed between the outer periphery of the shield receiver 140 and the body 120*a* of the inner middle. On the other hand, a metal top frame 147 is fitted in the bezel 142.

An elastic annular outer peripheral shock absorber 148 made of synthetic resin is disposed between the inner middle 120 and the outer middle 121. The middles are fixed to each other by fixing screws 150 radially disposed at four circumferential positions thereof and screwed in the inner middle 120. The shock absorber 148 engages the outer shell 122 of the outer middle 121 at a stepped portion 151 so that the shock absorber is not displaced nor disengaged although a shock may be applied to the outer middle.

Figure 29:
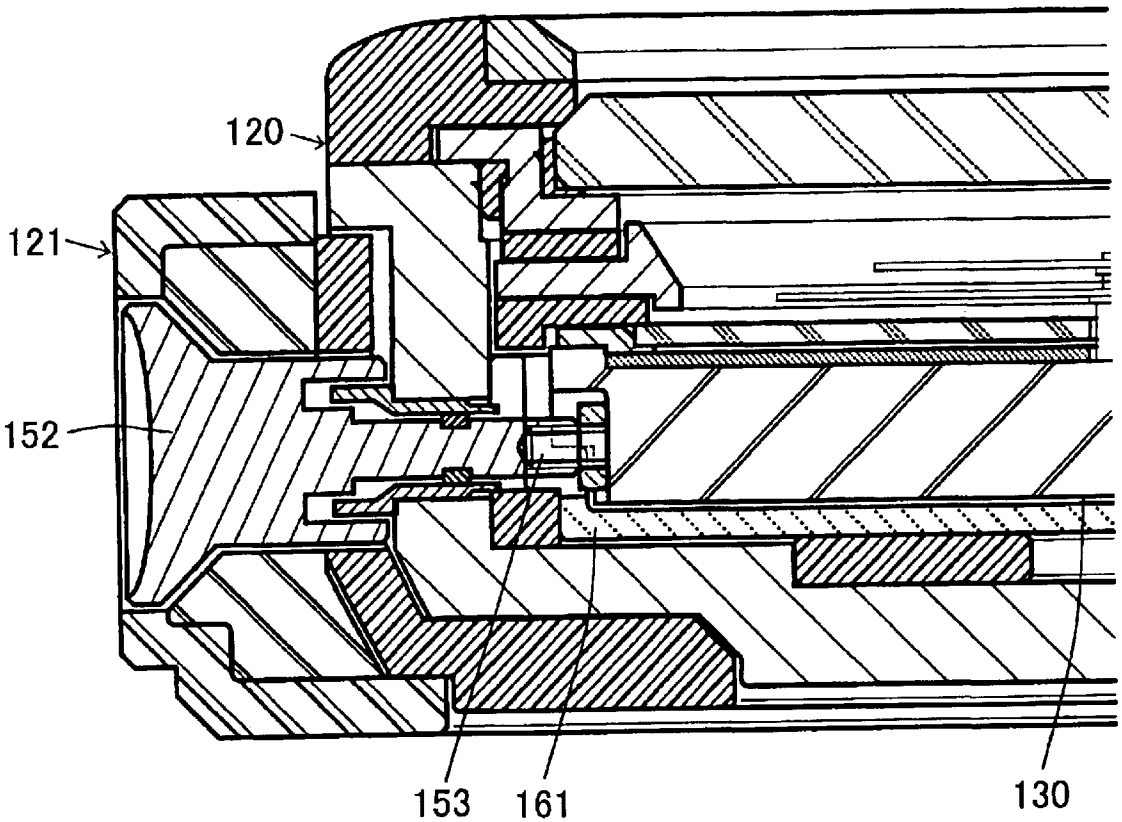
FIG. 29 is a sectional view taken along the same section line as that of FIG. 7.
Figure 30:
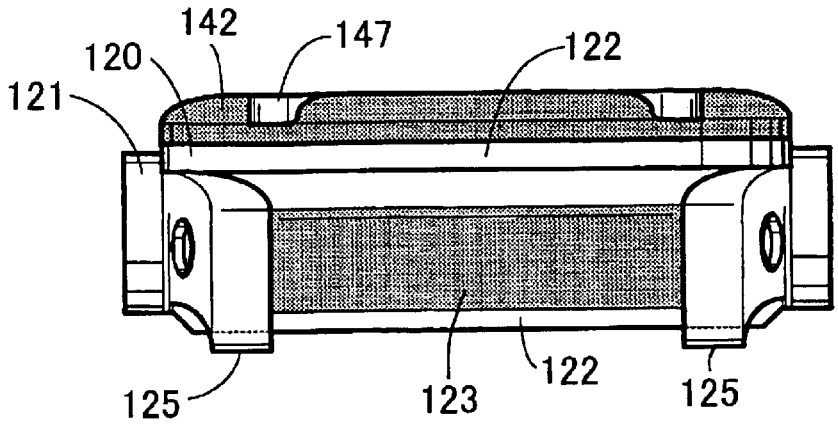
FIG. 30 is a side elevational view of a watch employing a watchcase of the sixth embodiment.
Figure 31:
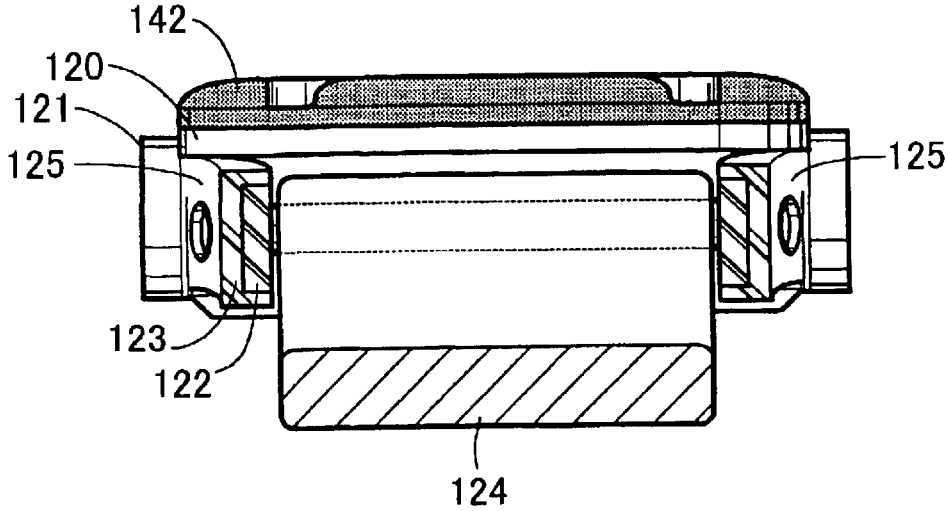
FIG. 31 is another side elevational view of the watch.
Figure 32:
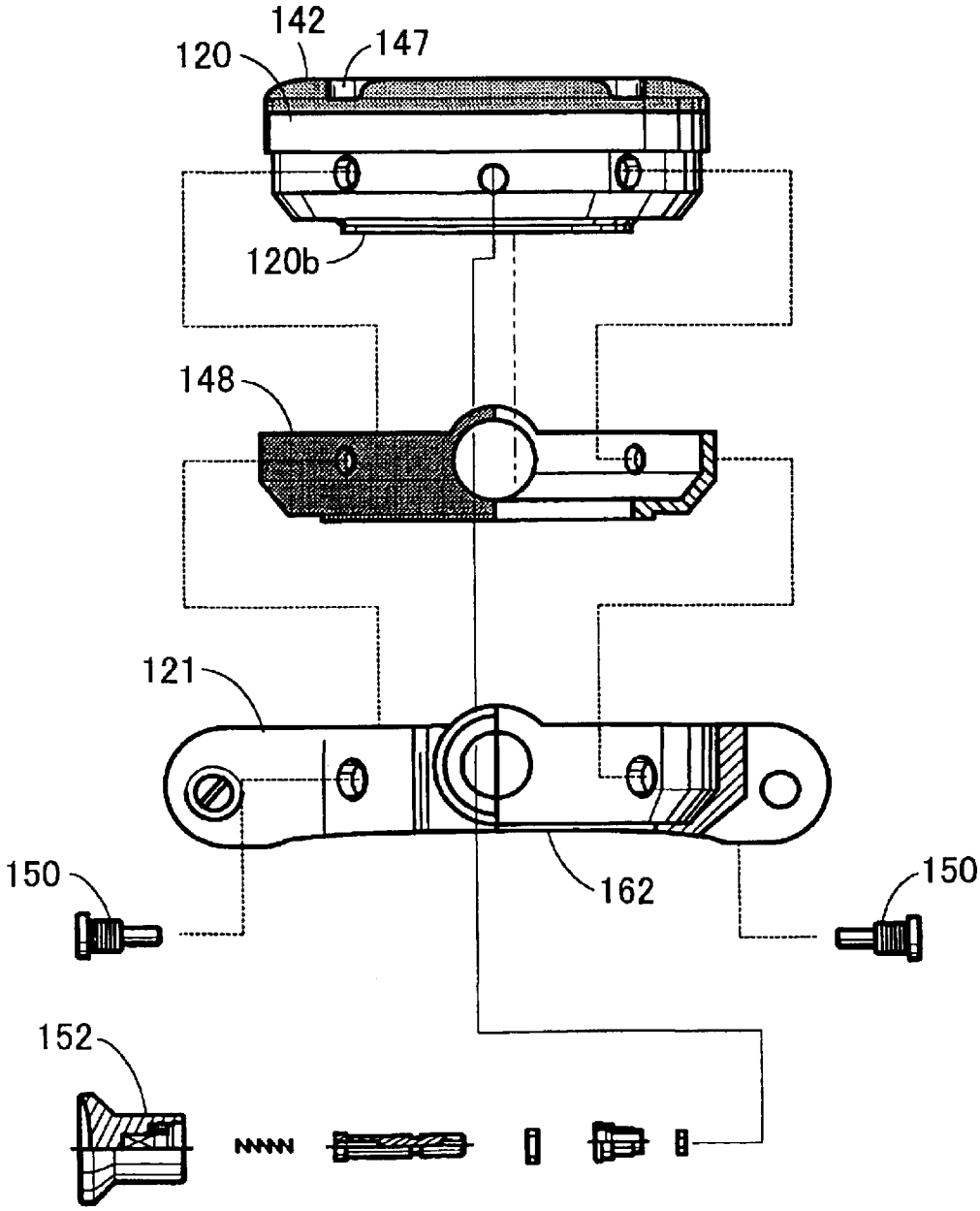
FIG. 32 is an exploded view showing the entire watchcase according to the sixth embodiment.
Figure 33:
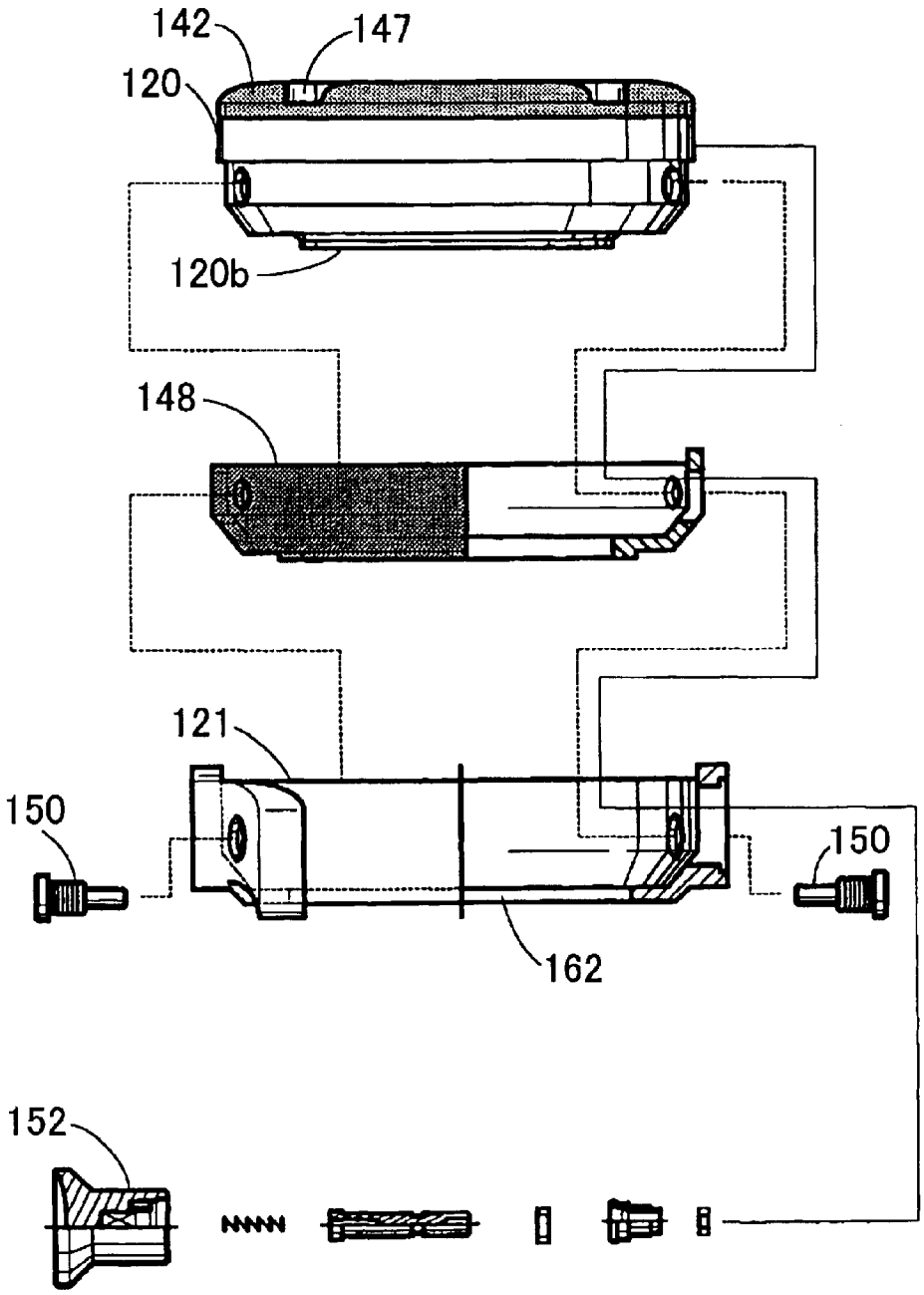
FIG. 33 is another exploded view showing the entire watchcase according to the sixth embodiment.
Figure 34:
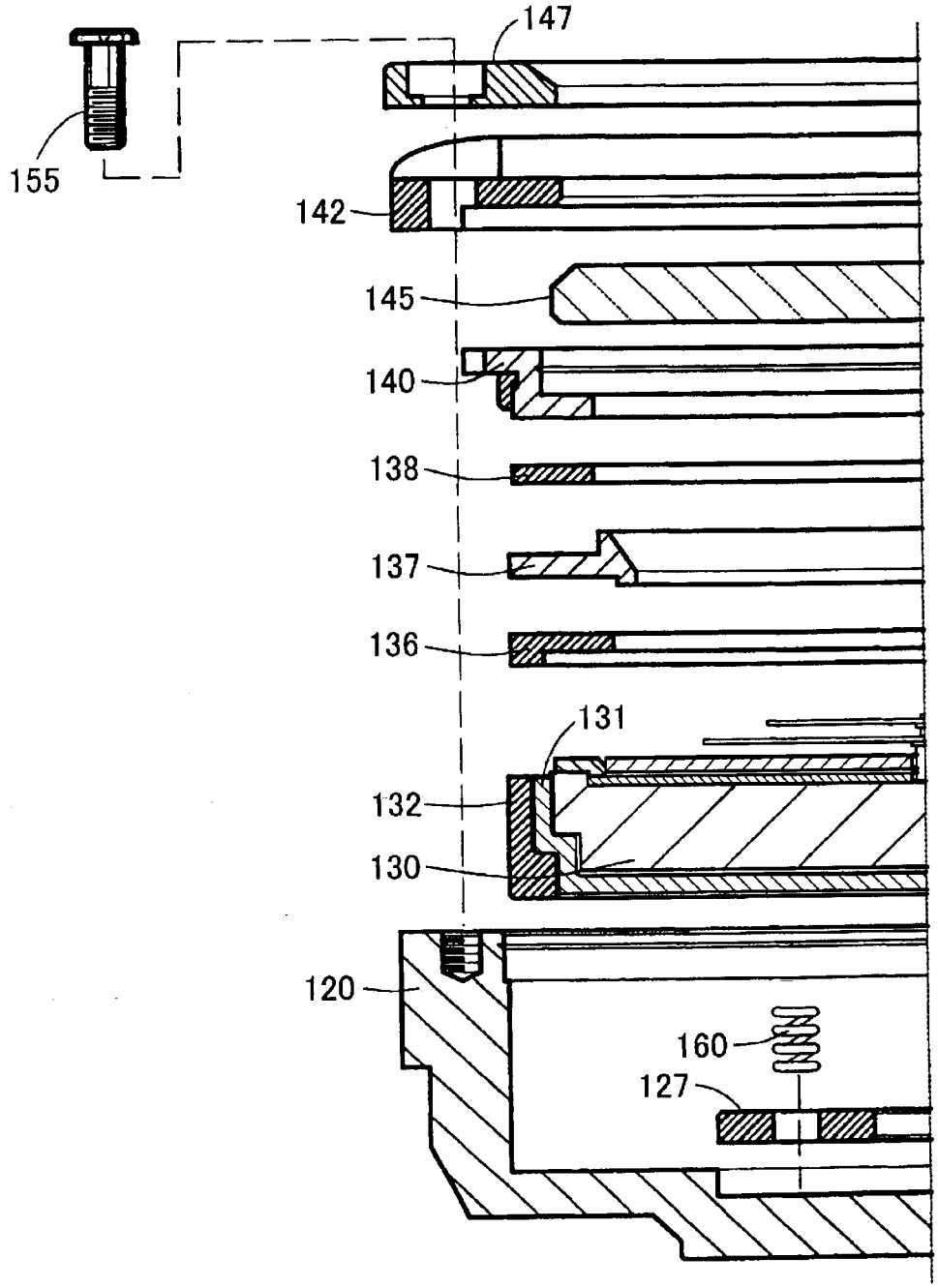
FIG. 34 is another exploded view of the entire watchcase.

As shown in FIG. 29, a crown 152 is rotatably supported by the inner and outer middles 120 and 121 and connected to a stem 153.

In accordance with the construction, a shock applied is absorbed by the elastic deformation of the soft outer shell 122 without being transmitted to the movement 130, so that the movement is protecting from the shock. The soft inner shell 123 maintains the strength of the outer middle. Since the outer shell 122 absorbs the shock, the inner shell is prevented from breaking with the shock;

The parts comprising the present embodiment will now be described in detail.

Figure 35:
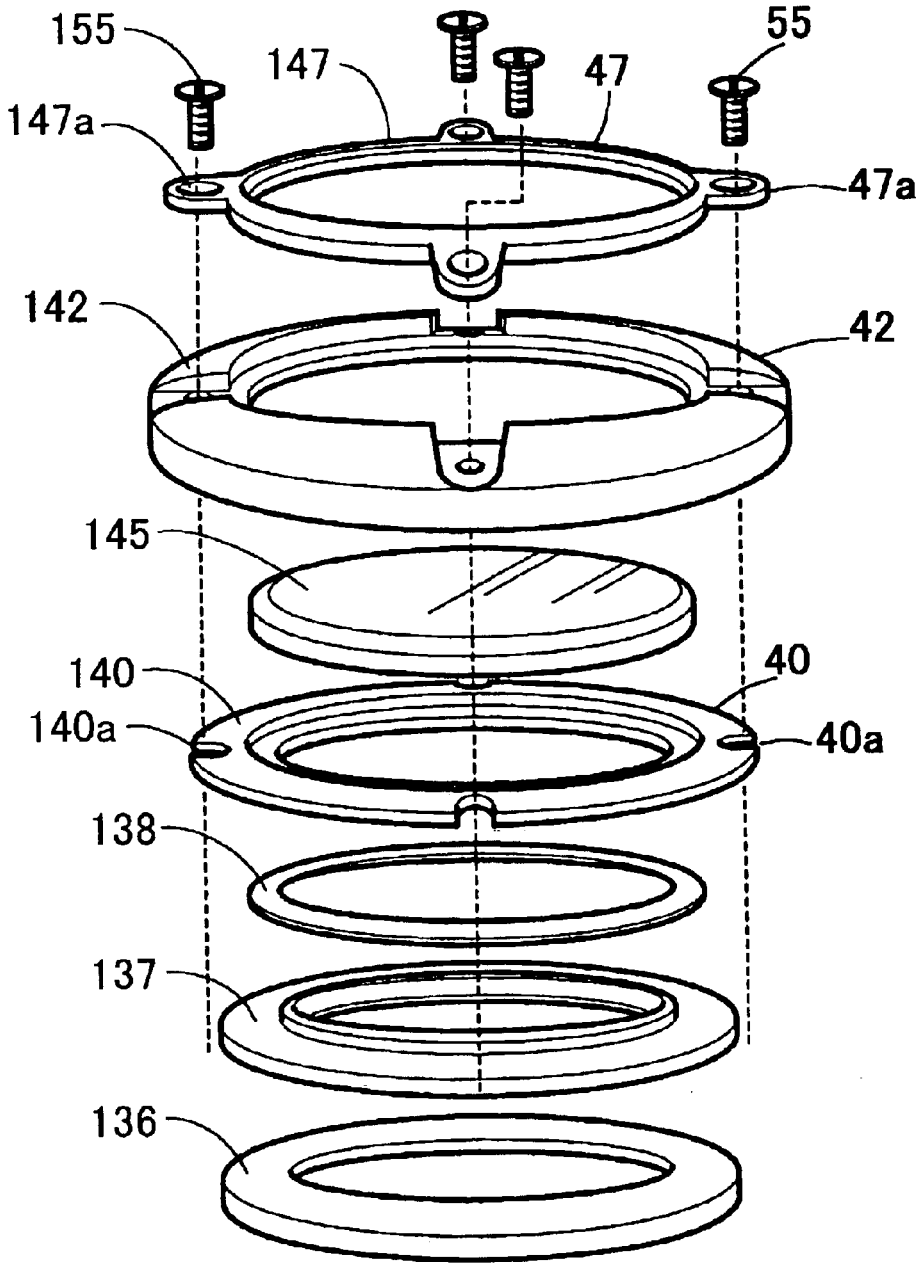
FIG. 35 is an exploded perspective view showing a part of the watchcase.
Figure 36:
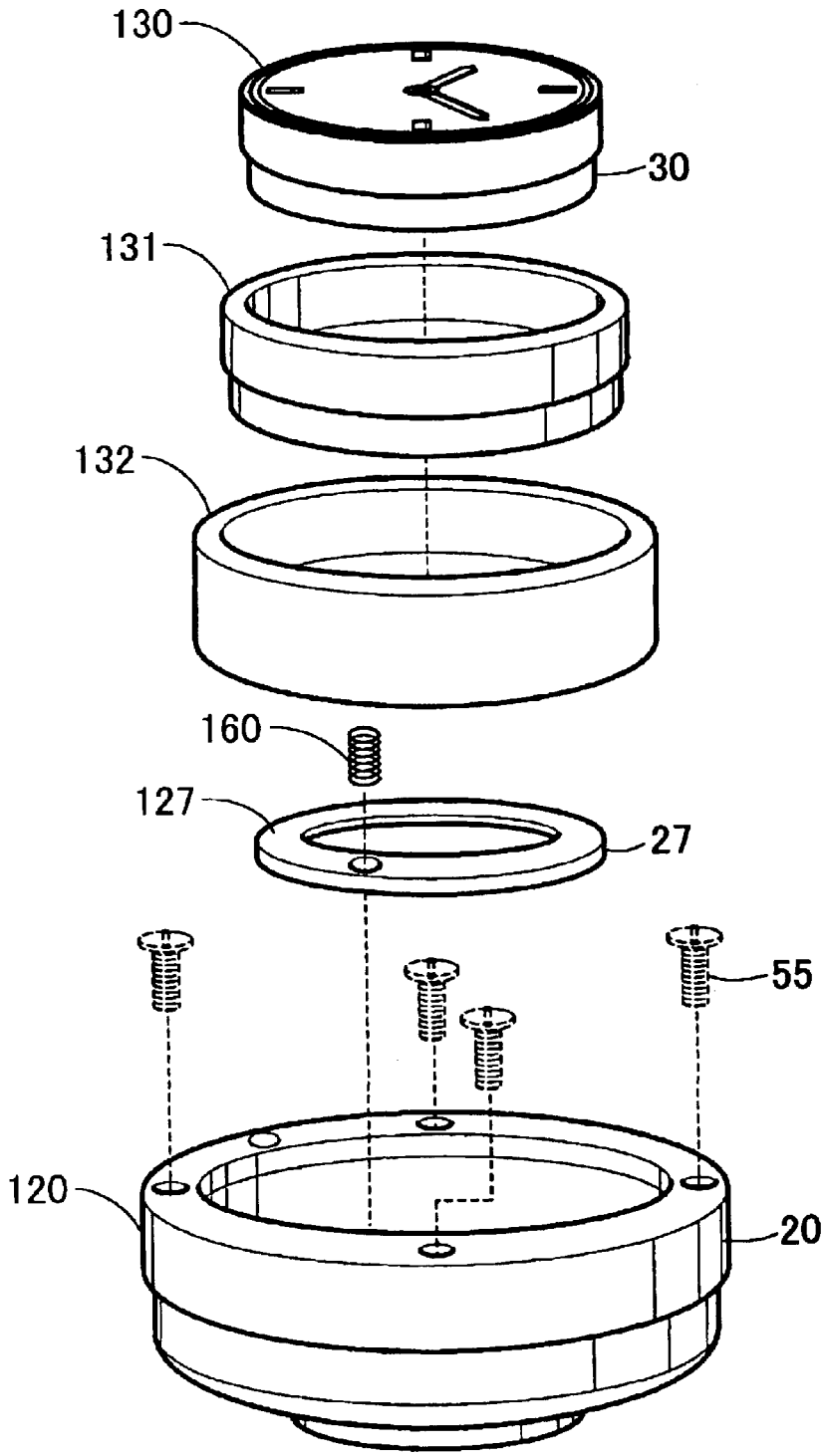
FIG. 36 is an exploded perspective view showing another part of the watchcase.

Referring to FIGS. 23 and 35, the top frame 147 has four projections 147*a*, so as to be attached to the body 120*a* of the inner middle 120 together with the bezel 142 (FIG. 27) by four screws 155. Each screw 155 penetrates a hole 142*a* formed in the bezel 142 and engages with a recess 140*a* formed in the periphery of the shield receiver 140. The top frame 147 is provided to impart abrasive resistance and anti-scratch property to the soft bezel 142.

The bezel 142 has an inner peripheral lower recess 156 (FIG. 26) with which the outer peripheral edge of the shield receiver 140 is engaged. The bezel 142 has a slant 157 at the inner peripheral lower edge against which a slant 158 at the outer peripheral edge of the shield 145 abuts.

The movement shock absorber 136 has a recess 136*a* with which the dial fixing portion 134 is engaged.

Due to the bezel 142 and shock absorbers 138 and 136, the above described construction thus enables to prevent a shock applied from above the bezel 142 to be transmitted to the inner middle 120, the movement 130 provided therein and other portions.

In addition, an axial or radial shock which may be applied to the shield 145 is received by the slant 157 of the bezel 142, so that the shield is prevented from becoming disengaged. With regard to the radial shock, bezel 142 absorbs the external force so as to protect the shield. Since screws 155 engage with the recesses 140*a* of the shield receiver 140, deflection of the members are prevented.

The shock absorber 138 for the ring 137 prevents either the shield receiver 140 or the ring 137 from breaking when a shock applied to the shield 145 causes these members to crash against each other, and also the shield itself from breaking. Moreover, the shock to the shield is prevented from being transmitted to the movement 130.

On the other hand, the ring 137 has upward and downward extensions 137*a* and 137*b* (FIG. 27), which conceal the shock absorbers 138 and 136, respectively. More particularly, the extension 137*a* is extended to the position adjacent the shield receiver so that the shock absorber is concealed from the outside. In addition, since the extension 137*a* abuts against the shock absorber 138, the ring is prevented from breaking although a radial shock may be applied.

The shock absorber 136 for the movement prevents the axial shock from transmitting to the movement 130 and further prevents the ring 137 from abutting against the movement. Moreover, the shock absorber abuts against the upper circumference of the dial 135 to hold it.

The cylindrical shock absorber 132 absorbs the external force to be exerted on the outer middle 121 and the inner middle 120 to prevent the transmission thereof to the movement. A step 132*a* holds the movement, interposing the magnetic shielding member 131.

The underside recess 136*a* of the shock absorber 136 for the movement receives the shock to be exerted on the movement in the radial direction thereof, thereby to protect the movement.

The bottom shock absorber 127, which is disposed in a recess 120*c* formed in the bottom 120*b*, absorbs an axial shock so as to protect the movement. The inner wall of the recess 120*c* prevents displacement and deformation of the shock absorber 127.

Furthermore, a spring 160 for grounding penetrates the shock absorber 127 and is connected to the inner middle 120. Hence the spring 160 is not disengaged.

In addition, static electricity which is liable to be transmitted from the inner middle to the movement 130 flows toward the bottom of the inner middle through the spring 160, and further to the human body through the exposed underside of the inner middle. Accordingly, the break down of the movement due to the static electricity is prevented.

A metallic annular axial movement restricting member 161 is disposed between the crown 152 (FIG. 29) and the movement 130 so as to surround the stem 153.

A circular opening 162 is formed in the bottom of the outer middle 121, through which the bottom 148*a* of the shock absorber 148 is shown. A part of the shock absorber covers a part of the bottom of the inner middle and protrudes outward of the opening.

Since the bottom 140*a* of the shock absorber 148 exists in the opening 162 of the outer middle 121, and further projects out of the bottom of the inner middle, it is possible to absorb a shock applied to the inner middle when the watchcase is dropped. Moreover, since the shock absorber 148 flexibly comes in contact with the wrist, the wearing feeling is improved.

Thus in accordance with the present embodiment, parts in the watchcase, especially the movement and the shield, are protected from various shocks so that accidents can be prevented.

Figure 37:
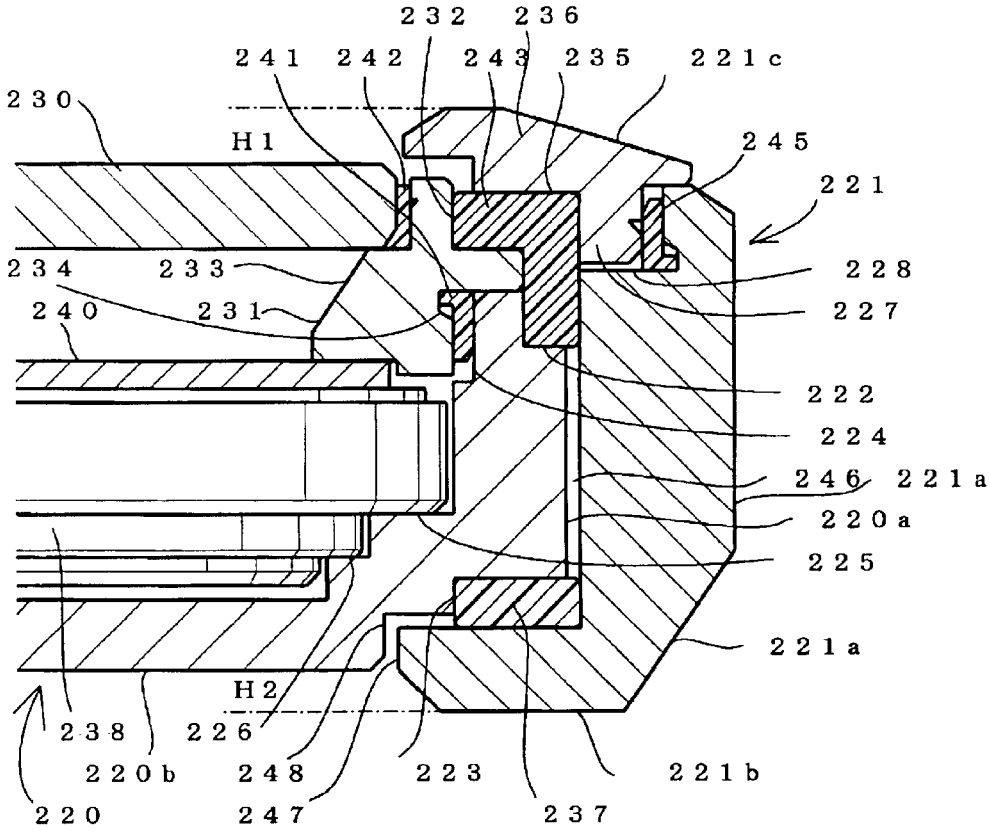
FIG. 37 is a sectional view of a seventh embodiment of the present invention.

FIG. 37 shows the sectional view of the seventh embodiment of the present invention.

The watchcase according to the present embodiment includes a metallic inner middle 220 and a metallic outer middle 221. Such metals as stainless steel, titanium, and brass are used for each case.

The inner middle 220 comprises an annular peripheral wall 220*a* and a bottom 220*b*. Along the upper peripheral edge of the peripheral wall 220*a*, there is formed an annular upper recess 222 for holding a shock absorber, and along the lower peripheral edge, there is formed an annular lower recess 223 for engaging a shock absorber.

Along the inner periphery of the inner middle 220, there are formed a seal receiving recess 224 at an upper portion, and a movement receiving recesses 225 and 226 at a lower portion.

In addition, an ornamental ring 231 for supporting a shield 230 has an upper outer recess 232, inner recess 233 and a downward recess 234.

The outer middle 221 is divided into an annular lower middle 221*a* and an annular upper middle 221*c*.

On an upper portion of the upper middle 221*c*, there is formed an inwardly projecting overhang 236. An annular lower projection 227 is formed to downwardly protrude from the underside of the upper middle 221. Hence a downwardly opened recess 235 is formed in the underside of the overhang 236.

On a lower portion of the lower middle 221, there is formed an inwardly projecting supporting portion 221*b*, and on an inner upper periphery of the lower middle 221*a*, there is formed a recess 228 for receiving the lower projection 227 of the upper middle 221*c*.

Furthermore, there are provided an upper shock absorber 243 and a lower shock absorber 237. The shock absorbers 237 and 243 are made of material capable of elastic deformation such as soft synthetic resin and rubber. For example, polyurethane can be used.

The entire structure will be described in accordance with the constructing order.

In the inner middle 220, a movement 238 is mounted in the recesses 225 and 226. The ring 231 is disposed on the movement 238 interposing a dial 240, and securely mounted in the inner middle by being pressed against the inner wall of the recess 224 of the inner middle interposing a fixing seal 241, thereby holding the dial 240 and the movement 238. The shield 230 is further secured to the ring 231 by a seal 242.

The annular lower shock absorber 237 made of polyurethane is mounted on the upper surface of the supporting portion 221*b* of the outer middle, abutting against the inner wall of the lower middle 221*a*. The upper shock absorber 243 made of polyurethane and having a section of an inverted L is mounted in the upper recess 222 of the inner middle 220 and the upper recess 232 of the ring 231. Thereafter, the inner wall of the lower middle 221*a* of the outer middle 221 is pressed against the upper shock absorber. 243 so as to be engaged therewith, and the supporting portion 221*b* presses the lower shock absorber 237 against the lower recess 223 of the inner middle. Additionally, the projection 227 of the upper middle 221*c* is forcibly inserted into the lower middle 221*a* interposing a fixing seal 245, and the upper middle 221*c* is pressed against the upper shock absorber 243.

In the thus assembled watchcase, there is formed a space 246 between the outer peripheral wall 220*a* of the inner middle 220 and the inner peripheral wall of the lower middle 221*a* wherein the shock absorber 243 is not disposed. That is, the dimensions of both the middles and the shock absorbers 243 and 237 are determined so as to form the space 246.

In order to prevent an inner peripheral wall 247 at the edge of the supporting portion 221*b* from contacting with a wall 248 of the inner middle 220, and the underside and the inside periphery of the overhang 236 of the upper middle 221*c* from contacting the ring 231, there are formed spaces between these members.

The members are so dimensioned to provide a difference H1 in height between the upper surface of the overhang 236 of the upper middle 221*c* and the upper surface of the shield 230, and a difference H2 in height between the underside of the supporting portion 221*b* and the underside of the bottom 220*b* of the inner middle 220.

The space 246 and the differences H1 and H2 prevent a shock applied to the outer middle 221 from directly transmitting to the inner middle 220. If the shock absorbers 243 and 237 are elastically deformed by the exerted shock, the outer middle 221 and the inner middle 220 are prevented from crashing against each other.

Figure 40:
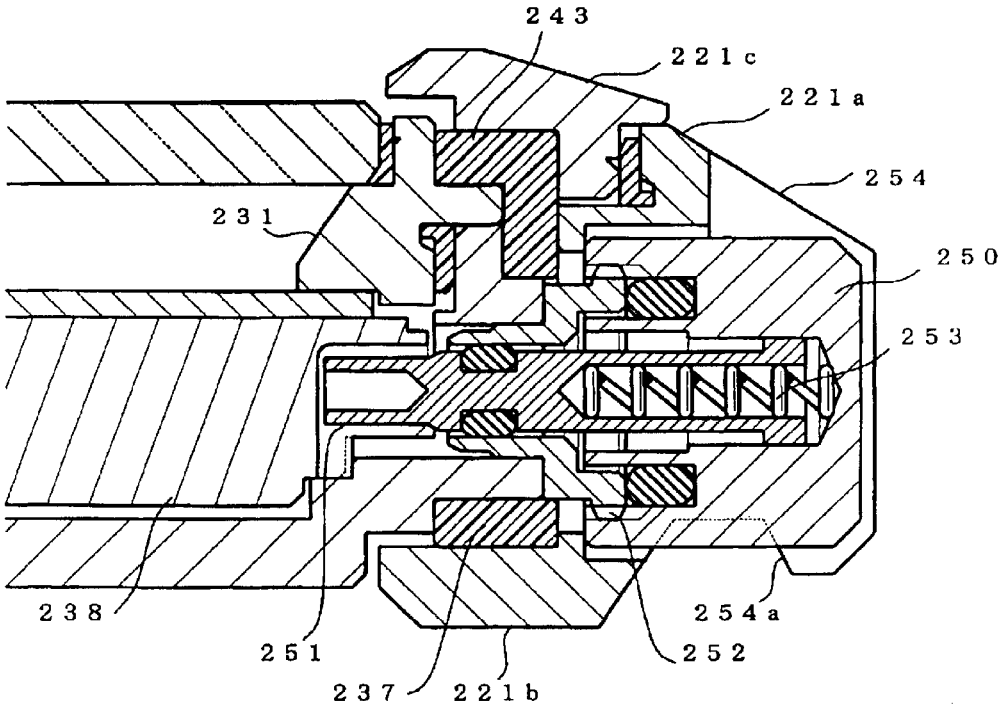
FIG. 40 is a sectional view taken along a line intersecting a crown.

FIG. 40 is the sectional view taken along the line intersecting a crown.

A crown 250 is connected to a stem (not shown) in the movement 238 through a connecting pin 251. The crown is rotated to release a screw thread 252 so that a spring 253 urges the crown to project out of a pair of crown guards 254. By rotating the projected crown, the stem is rotated by way of the pin 251, thereby to carry out the hand adjustment and other operations.

Figure 38:
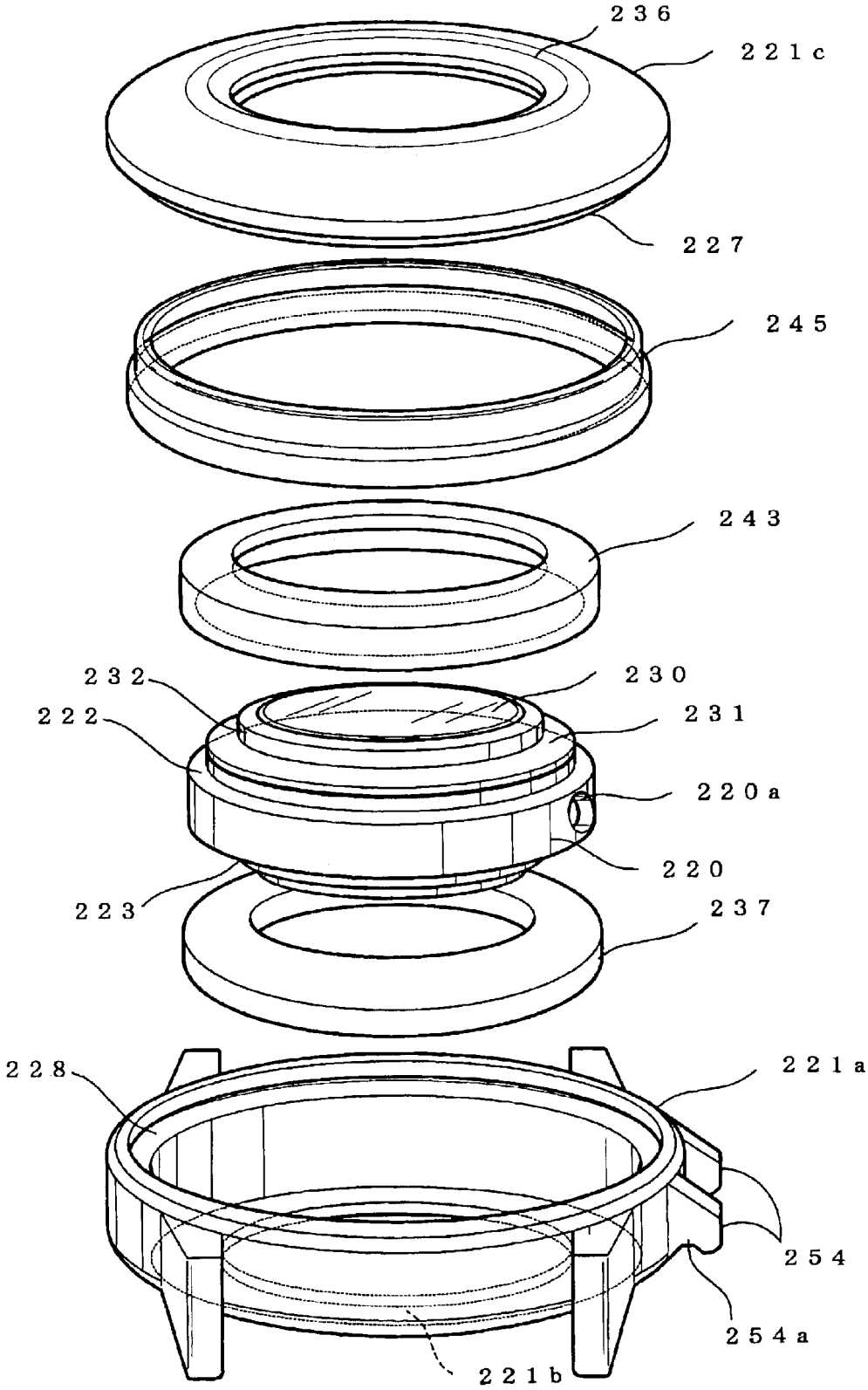
FIG. 38 is an exploded perspective view showing the entire watchcase according to the seventh embodiment.
Figure 39:
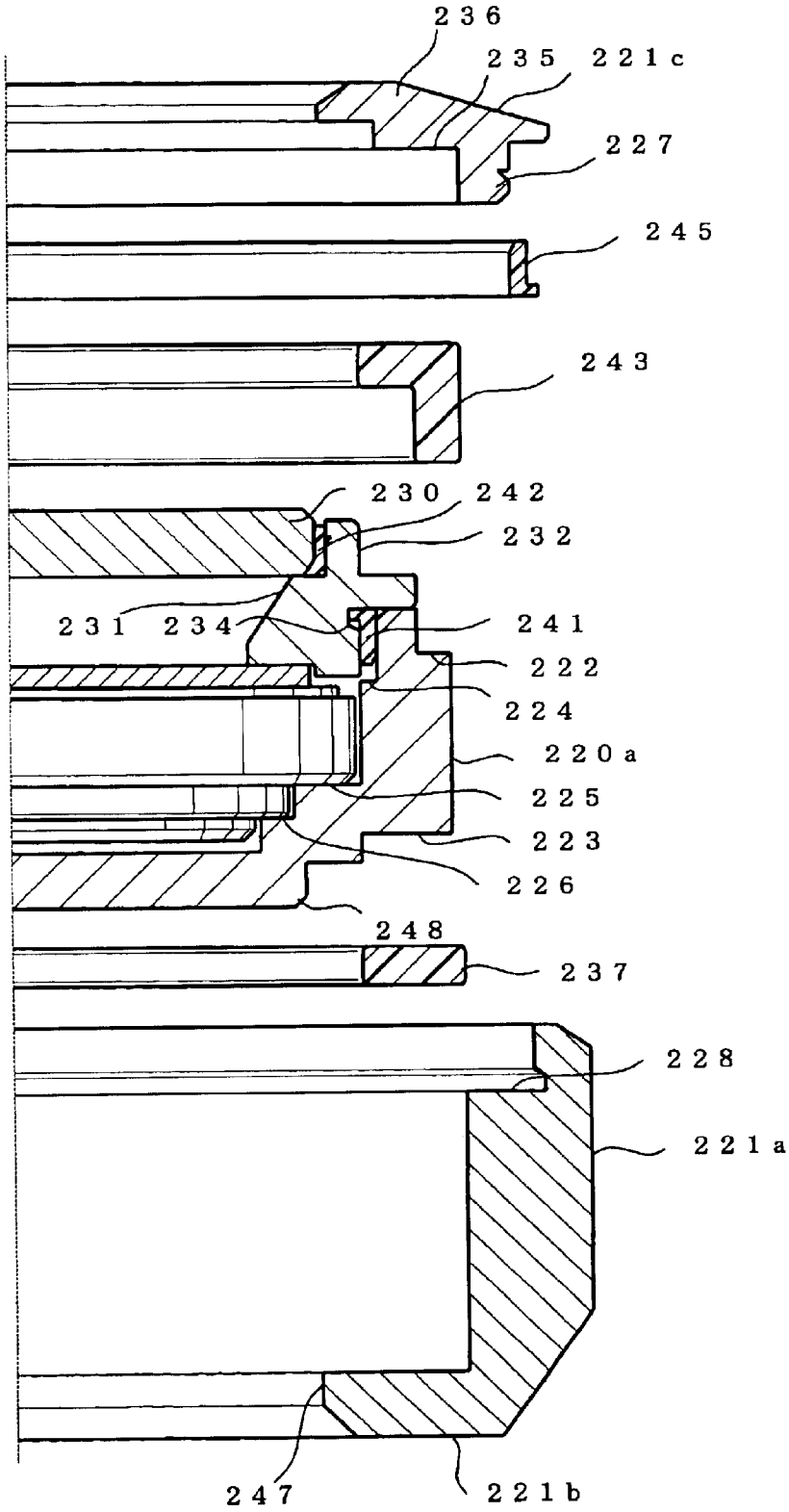
FIG. 39 is an exploded sectional view of the watchcase.

In accordance with the present embodiment, as shown in FIG. 38, each of the crown guards 254 has a notch 254*a* at an inner position of the end of the guard. As can be clearly seen in FIG. 40, each notch 254*a* is cut deeper than the outer periphery of the crown so that by inserting fingers therein, the crown 250 can be rotated to eject outward.

In accordance with the present embodiment, the inner middle 220 and the outer middle 221 are attached to each other by pressing the shock absorber 237 and 243 against the other without using screws. A space is formed between the inner middle 220 and the outer middle 221 except at portions where the shock absorbers 237 and 243 are disposed. Thus an external shock applied to the outer middle 221 is absorbed by the shock absorbers without being transmitted to the inner middle 220.

Since the lower shock absorber 237 is disposed under the inner middle 220 contacting the underside thereof, a shock which may be applied to the supporting portion 221*b* from the underside of the watchcase is absorbed by the shock absorber and is hardly transmitted to the inner middle 220.

The supporting portion 221*b* of the outer middle 221 which supports the inner middle 220 from below covers the middle. Therefore, the inner middle 220 is prevented from disengaging from the outer middle 221 either in the upper or lower directions.

Moreover, since the differences H1 and H2 are formed, the shield 230 and the inner middle 220 are less liable to hit an object on the ground when the watch is dropped.

Furthermore, the outer middle 221 and the inner middle 220 are made of metal so as to have sufficient strength, anti-scratch property and abrasion resistance.

Meanwhile, the notches 254*a* are formed in the crown guards 254 through which the crown 250 is exposed. Thus the fingers can be inserted through the notches to operate the crown with ease.

Since the notch 254*a* is formed in the underside of each crown guard 254, the notch 254 is not apparent when the watch is seen from above, so that the appearance of the watch is not deteriorated. Moreover, since the wrist blocks the notches 254*a*, a shock is not directly applied to the crown 250 although the outer periphery of the crown is exposed from the notches 254*a*.

Since the notches 254*a* are formed so as not to cut off the end portion of the crown guards 254, the notches are concealed from view when seen from the side of the watch, thereby maintaining the appearance of the watch. Furthermore, a shock which may be applied to the side of the watchcase is not directly transmitted to the crown 250.

Figure 41:
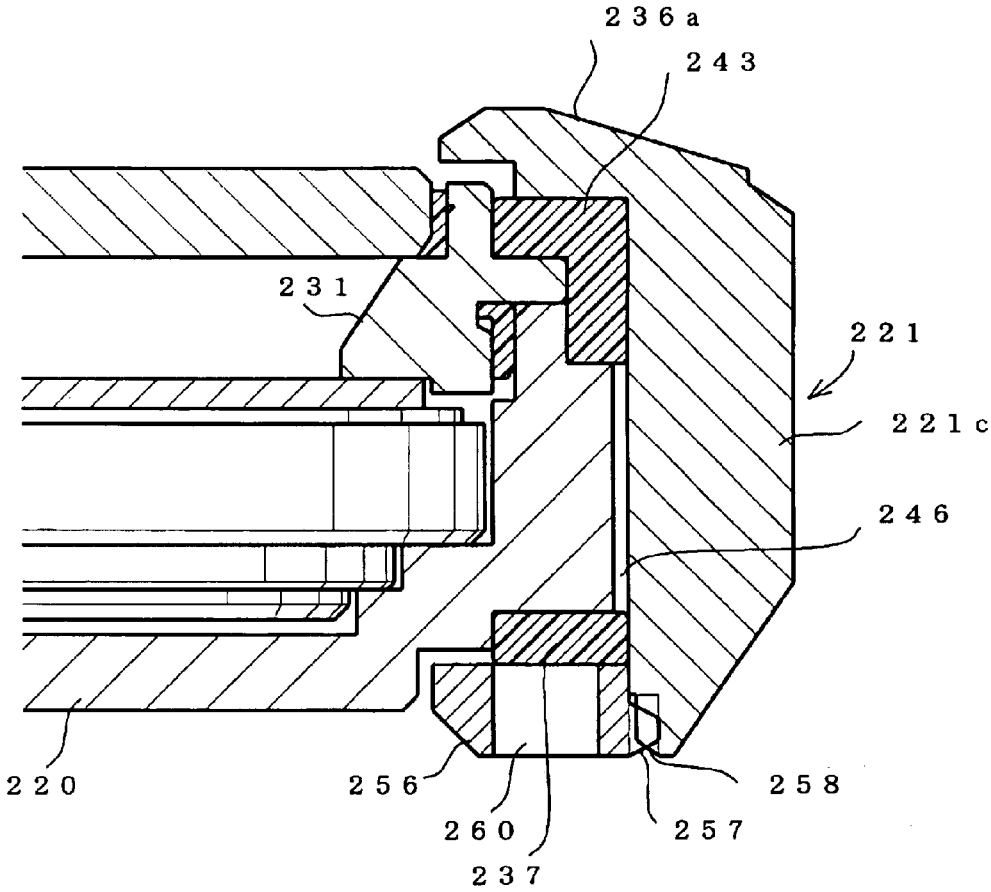
FIG. 41 is a sectional view showing an eighth embodiment.
Figure 42:
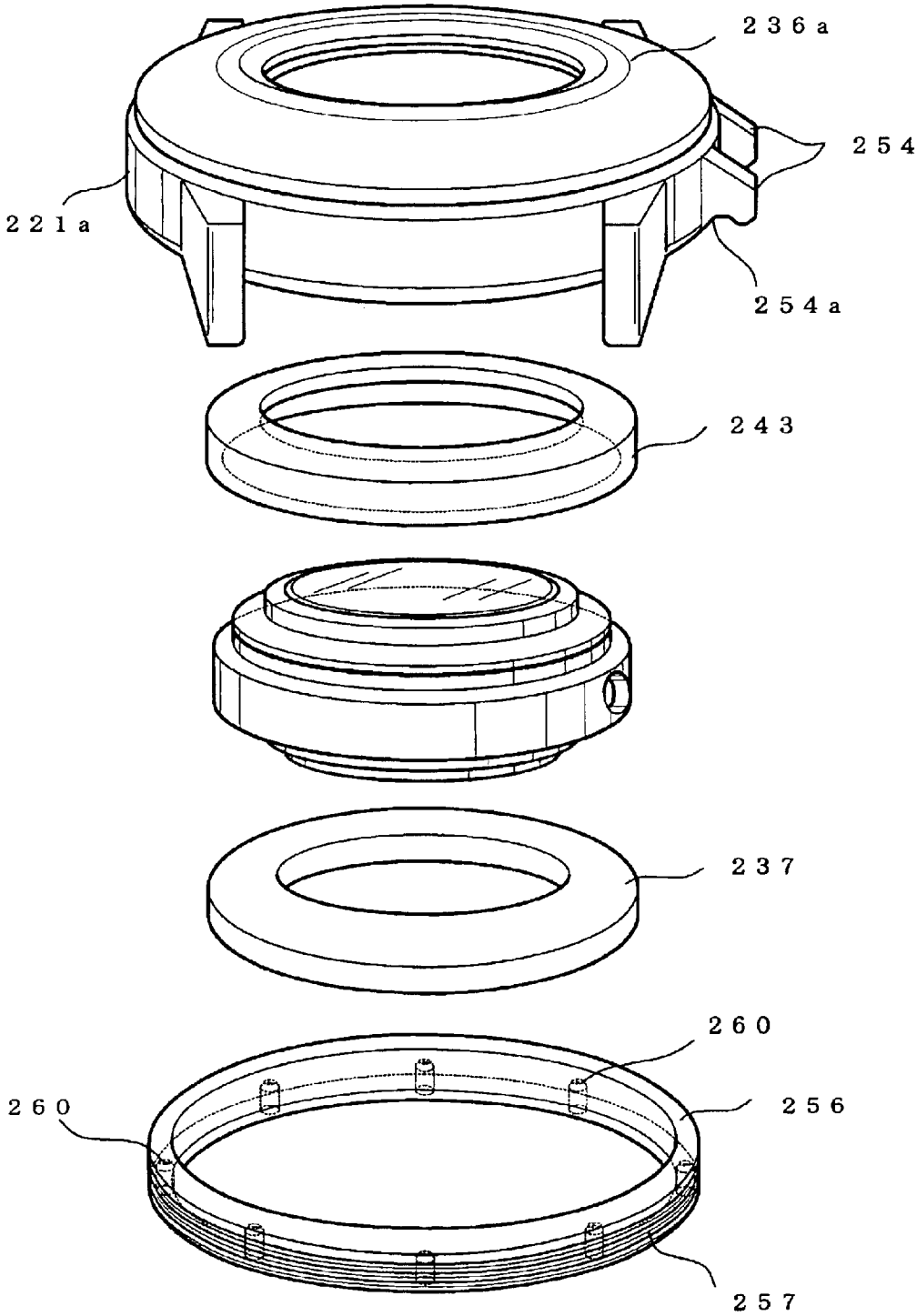
FIG. 42 is an exploded perspective view of the eighth embodiment.
Figure 43:
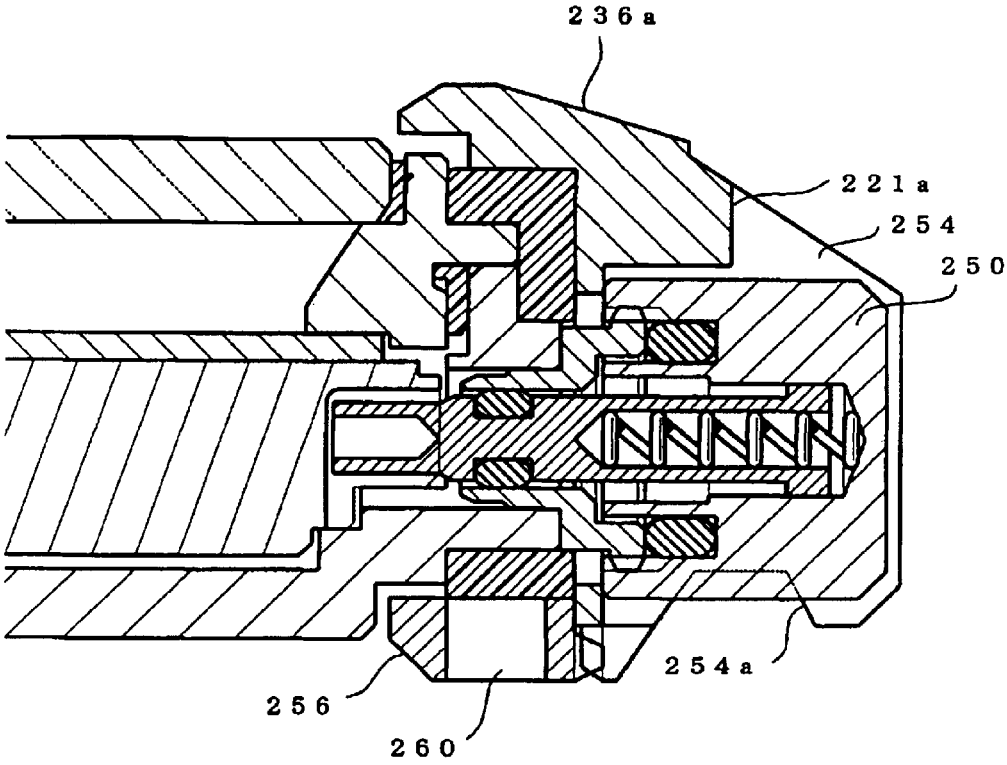
FIG. 43 is a sectional view taken along a line intersecting a crown.

FIG. 41 shows the sectional view of the eighth embodiment, FIG. 42 shows the exploded perspective view thereof, and FIG. 43 shows the sectional view taken along the line intersecting the crown.

The present embodiment differs from the seventh embodiment in that the upper middle 221*c* and the lower middle 221*a* in the seventh embodiment are integrated to form the upper middle 221*c* of the eighth embodiment. The upper middle 221*c* has an overhang 236*a*, same as in the seventh embodiment. On the other hand, the supporting portion 221*b* in the seventh embodiment is independently formed, thereby providing an annular lower middle 256.

A male screw thread 257 formed on the outer periphery of the lower middle 256 engages a female screw thread 258 formed on the lower inner periphery of the upper middle 221*c* so that the upper middle 221*c* and the lower middle 256 are attached to each other.

The inner middle 220 has the same construction as that of the seventh embodiment.

A plurality of tool inserting holes 260 are formed in the lower middle 256 as shown in FIG. 42. The lower middle 256 can be rotated when a tool is inserted in the vertically penetrating holes 260 so as to be screwed into the upper middle 221*c*.

The tool inserting holes 260 are blocked by the lower shock absorber 237. Hence water, sand and mud do not enter the space 246 between the inner middle 220 and the outer middle 221. Each of the tool inserting holes 260 may be a radial hole with a bottom having a radially outward opening.

The other constructions are the same as those of the seventh embodiment so that the same parts are designated by the same reference numerals, thereby omitting further descriptions. The effect is also the same as that of the seventh embodiment.

Figure 44:
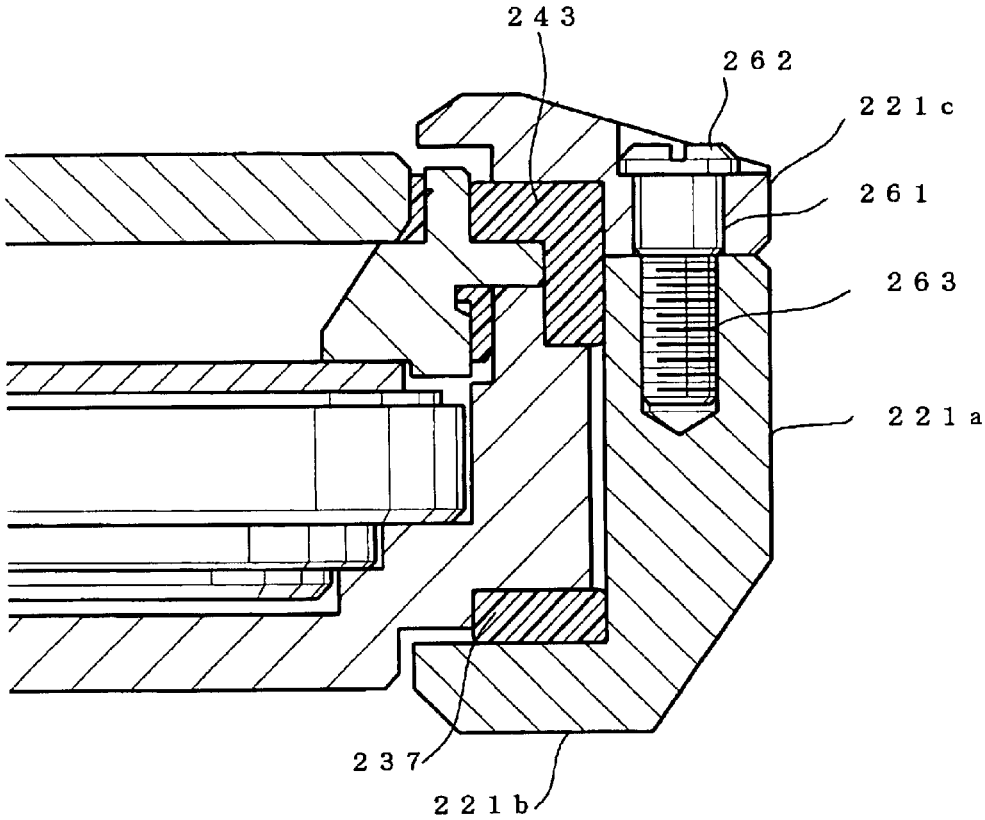
FIG. 44 is a sectional view showing a ninth embodiment.
Figure 45:
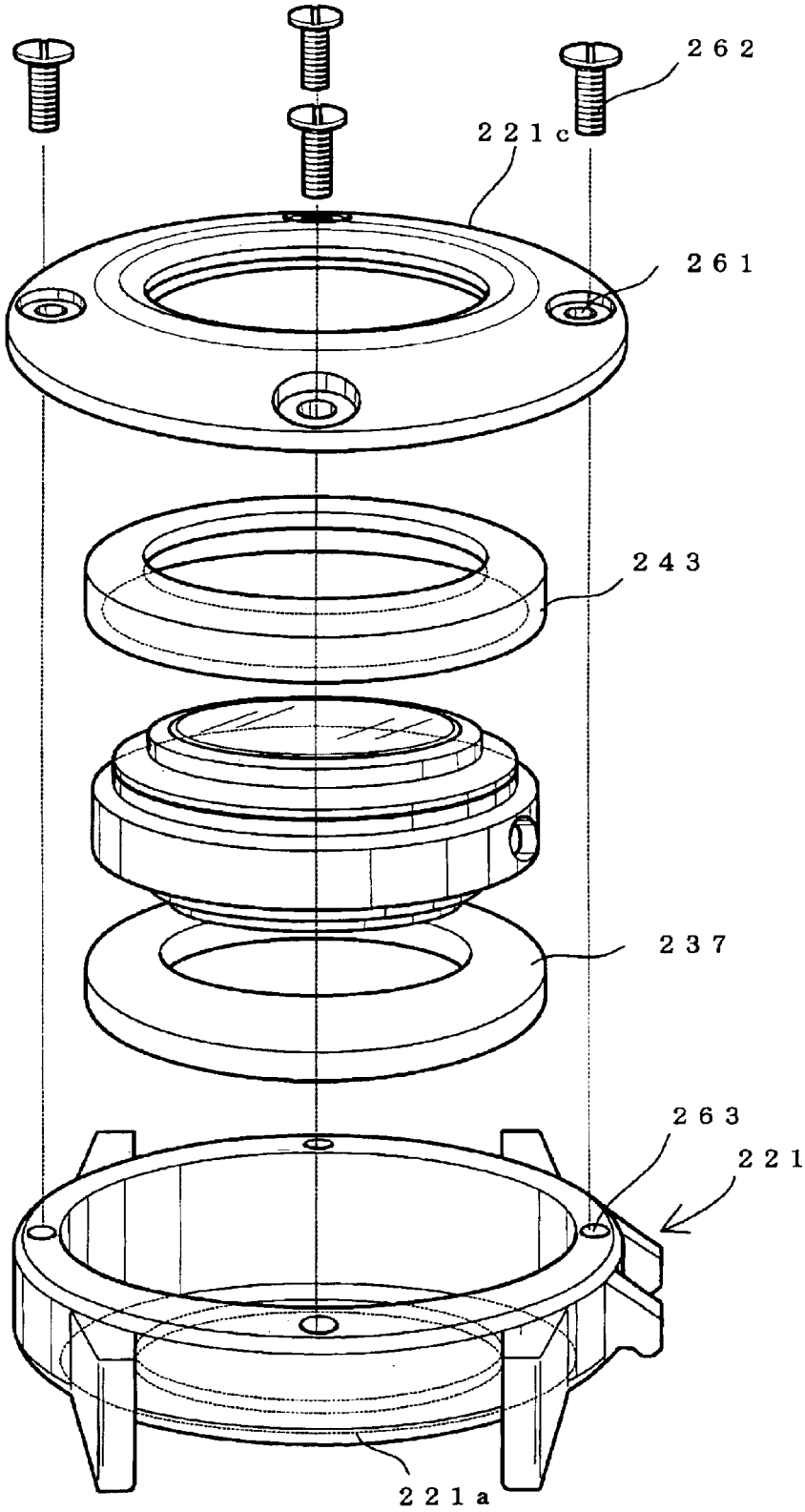
FIG. 45 is an exploded perspective view of the ninth embodiment.

FIG. 44 shows the sectional view of the ninth embodiment, and FIG. 45 shows the exploded perspective view thereof.

In the embodiment, the upper middle 221*c* of the seventh embodiment has four holes 261. Each hole 261 is a recessed hole vertically penetrating the upper middle 221*c*. Four fixing screws 262 inserted in the corresponding holes 261 are engaged with respective screw holes 263 formed in the lower middle 221*a*. The upper middle 221*c* and the lower middle 221*a* are hence attached to each other. The upper middle 221*c* and the lower middle 221*a* are securely attached without the seal 245 of the seventh embodiment.

It is preferable to dispose the fixing screws 262 avoiding the upper shock absorber 243. If holes and notches for allowing the screws 262 to pass through are formed in the shock absorber 243, the structure of the shock absorber 243 becomes complicated. Not only does it render it difficult to keep the manufacturing cost low, but also causes the shock absorber 243 to be prevented from elastically deforming.

The other features are the same as in the seventh embodiment.

Figure 46:
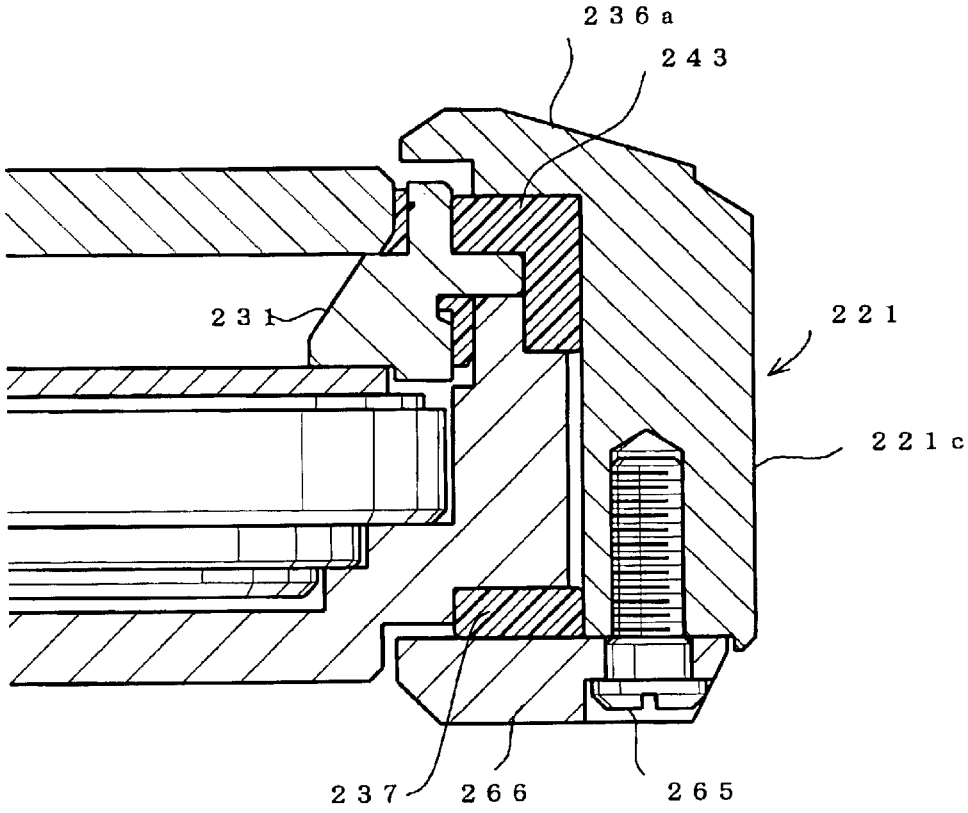
FIG. 46 is a sectional view showing a tenth embodiment.
Figure 47:
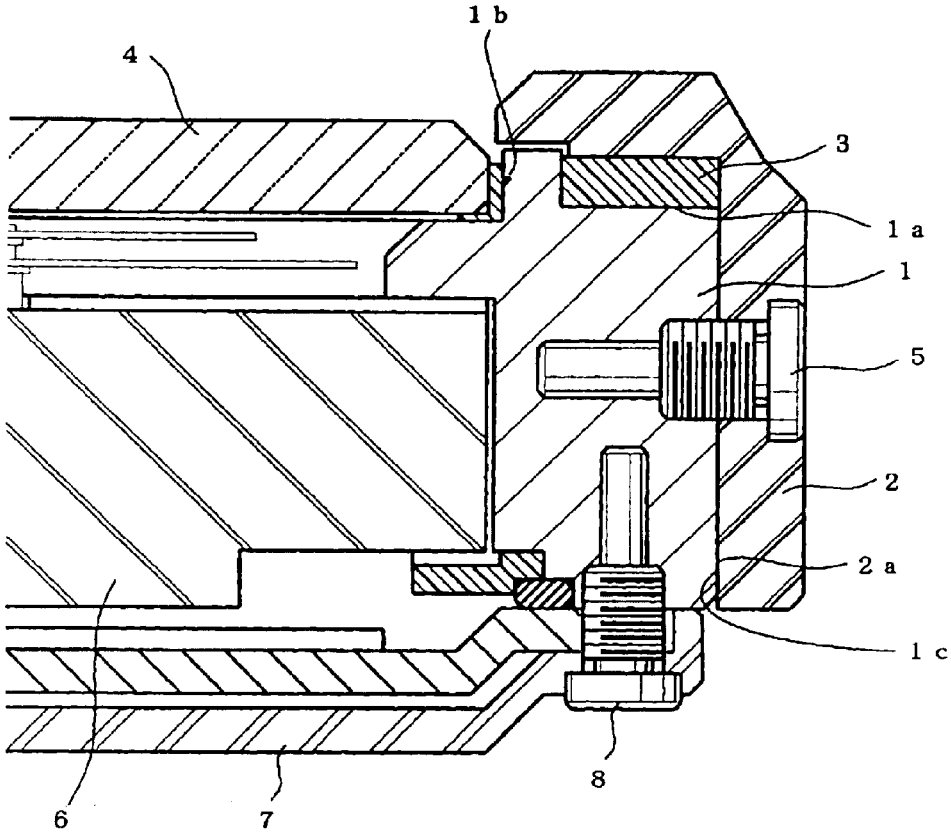
FIG. 47 is a sectional view of a conventional watchcase.

FIG. 46 shows the sectional view of the tenth embodiment.

In the embodiment, a lower middle 266 is attached to the upper middle 221*c* by a plurality of fixing screws 265 instead of by the engagement of the male screw thread 257 and the female screw thread 258 of the eighth embodiment. More particularly, the fixing screws 265 inserted in a plurality of holes vertically penetrating the lower middle 266 are screwed in the upper middle 221*c*. Each fixing screw 265 is preferably disposed avoiding the lower shock absorber 237.

The other features are the same as in the eighth embodiment.

Although a specific watertight structure is employed for the inner middle 220 in each of the embodiments, the present invention can be realized regardless of the structure of the inner middle 220.

If priority is not given to the abrasion resistance and anti-scratch property, the outer middle may be made of other materials besides metal.

Although the screw-lock crown is employed as a crown, the notches formed in the crown guards are effective in other types of crown. As another construction of the crown, it is possible to use such a crown that the crown is pulled or rotated to wind a screw in the movement.

In accordance with the seventh to tenth embodiment, since the outer middle is secured to the inner middle only through the shock absorber and the outer middle is not in contact with the inner middle, an externally applied shock is hardly transmitted to the inner middle, so that the inner components are protected.

PROBABILITY OF INDUSTRIAL EXPLOITATION

In accordance with each of the embodiments, the outer middle is made of metal, thereby preventing problems such as scratch and abrasion caused by a contact or crash with external foreign objects.

The fixing screws for attaching the outer middle and the inner middle to one another each has an end engaged in the shock absorber inserted in a hole in the middle, so that although an external shock may be applied to the screws, the shock is not transmitted to the inner middle. Thus the movement, module and others provided in the inner middle are prevented from breaking.

Furthermore, since the movement restricting member is provided to surround the stem between the stem connecting member of the screw-lock crown and the movement, when a shock is applied to the head of the crown, the connecting member does not move, so that the stem is prevented from penetrating into the movement and breaking members provided therein. In addition, since the outer surface of the crown head is disposed at an inner side of the outer periphery of the guard pipe, a shock is not directly applied to the head. Hence the stem is not injured by the shock.

Moreover, the bottom of the shock absorber is exposed through the opening of the outer middle, so that the shock is absorbed when the case is dropped.

What is claimed is:

1. A watchcase comprising:

a middle comprising a metallic inner middle in which a movement is housed, and a metallic outer middle covering at least a part of the inner middle; and an elastic shock absorber disposed between the inner middle and the outer middle, wherein the shock absorber covers at least a part of an underside of the inner middle, and separates the inner middle and the outer middle so as to absorb an externally applied shock.

2. The watchcase according to claim 1 further comprising an engaging member attached to the outer middle and engaged with the shock absorber disposed between the inner middle and the outer middle.

3. The watchcase according to claim 1 wherein the outer middle engages in projection and recess engagement the shock absorber provided between the inner middle and the outer middle.

4. A watchcase comprising:

a middle comprising a metallic inner middle in which a movement is housed, and a metallic outer middle covering at least a part of the inner middle; and an elastic shock absorber disposed between the inner middle and the outer middle, wherein the outer middle has an opening through which the shock absorber provided between the inner middle and the outer middle is exposed.

5. The watchcase according to claim 4 wherein an elastic shock absorber is disposed so as to abut against a securing member.

6. A watchcase comprising:

a middle comprising an inner middle in which a movement is housed, and an outer middle covering at least a part of the inner middle;

an elastic shock absorber attached to one of the inner middle and the outer middle;

a securing member having securing means on a part thereof and attached to one of the inner middle and the outer middle by the securing means so as to oppose the other middle interposing the shock absorber at a portion where the securing means is not provided.

7. The watchcase according to claim 6 wherein the inner middle has an inserting hole in which an inner end of the securing member attached to the outer middle is inserted, and the shock absorber is disposed in the inserting hole.

8. The watchcase according to claim 6 wherein the outer middle has an inserting hole in which an outer end of the securing member attached to the inner middle is inserted, and the shock absorber is disposed in the inserting hole.

9. The watchcase according to claim 6 wherein the shock absorber is a cylinder provided with a bottom, or a ring, wherein the securing member can be inserted.

10. A watchcase comprising an inner middle in which a movement is housed and an outer middle covering at least a part of the inner middle, wherein the outer middle comprises an inner shell made of a hard material and an outer shell made of a soft material, the inner shell is exposed so as to oppose a band connected to the outer middle.

11. The watchcase according to claim 10 wherein the inner shell of the outer middle is molded from a hard synthetic resin and the outer middle is molded from a soft synthetic resin.

12. The watchcase according to claim 10 where the inner shell and the outer shell are integrally molded.

13. The watchcase according to claim 10 wherein the band is connected to the inner shell of the outer middle through a connecting member.

14. The watchcase according to claim 10 wherein a shock absorber disposed between the inner middle and the outer middle is exposed through an opening formed in an underside of an outer wall of the outer middle.

15. A watchcase comprising an inner middle in which a movement is housed and an outer middle covering at least a part of the inner middle, wherein the outer middle comprises an inner shell made of a hard material and an outer shell made of a soft material, a shock absorber made of soft material is disposed between the inner middle and the outer middle.

16. A watchcase comprising an inner middle in which a movement is housed and an outer middle covering at least a part of the inner middle, wherein the outer middle comprises an inner shell made of a hard material and an outer shell made of a soft material, the inner middle is provided with a bezel made of a soft material and a metallic top frame for partially covering the bezel.

17. The watchcase according to claim 16 wherein a projection formed on an underside of the outer wall of the inner middle is exposed through an opening formed in a shock absorber provided between the inner middle and the outer middle.

18. A watchcase comprising an inner middle in which a movement is housed and an outer middle covering at least a part of the inner middle, wherein the outer middle comprises an inner shell made of a hard material and an outer shell made of a soft material, further comprising a conductive means for electrically connecting an underside of the movement with an underside of an inner wall of the inner middle, and an underside of an outer wall of the inner middle is exposed from the outer middle.

19. A watchcase comprising an inner middle for housing a movement, and an outer middle for housing the inner middle, wherein the inner middle and the outer middle is attached to each other only by interposing a shock absorber therebetween, the outer middle comprises a supporting portion for supporting the inner middle and an overhang for covering a portion above the inner middle.

20. The watchcase according to claim 19 wherein the outer middle is divided into a lower middle provided with the supporting portion and an upper middle provided with the overhang, and has engaging means for engaging the lower middle with the upper middle.

21. The watchcase according to claim 20 wherein the engaging means is an engagement interposing a fixing seal compressed between the outer middle and the lower middle.

22. The watchcase according to claim 20 wherein the engaging means is a screw thread engagement between a screw thread formed in the upper middle and a screw thread formed in the lower middle.

23. The watchcase according to claim 20 wherein the engaging means is an engagement by a fixing screw.

24. The watchcase according to claim 19 wherein the shock absorber includes an upper shock absorber abutting on an upper surface of the inner middle and a lower shock absorber abutting on an underside of the inner middle.

25. The watchcase according to claim 19, wherein the shock absorber is disposed in a recess of the inner middle.

26. The watchcase according to claim 19 wherein the outer middle is made of metal.

27. A watchcase comprising an inner middle for housing a movement, and an outer middle for housing the inner middle, including a shock absorber provided between the inner middle and the outer middle, wherein a space is formed between the inner middle and the outer middle except for a portion where the shock absorber is disposed, the outer middle comprises a supporting portion for supporting the inner middle and an overhang for covering a portion above the inner middle.

* * * * *